US008294088B2

(12) United States Patent
Pringle

(10) Patent No.: US 8,294,088 B2
(45) Date of Patent: Oct. 23, 2012

(54) GAS ELECTRON MULTIPLIER DETECTOR

(75) Inventor: Steven Derek Pringle, Darwen (GB)

(73) Assignee: Micromass UK Limited, Manchester (GB)

( * ) Notice: Subject to any disclaimer, the term of this patent is extended or adjusted under 35 U.S.C. 154(b) by 0 days.

(21) Appl. No.: 12/745,265

(22) PCT Filed: Dec. 1, 2008

(86) PCT No.: PCT/GB2008/003969

§ 371 (c)(1),
(2), (4) Date: Oct. 14, 2010

(87) PCT Pub. No.: WO2009/068887

PCT Pub. Date: Jun. 4, 2009

(65) Prior Publication Data

US 2011/0024616 A1 Feb. 3, 2011

Related U.S. Application Data

(60) Provisional application No. 61/013,679, filed on Dec. 14, 2007.

(30) Foreign Application Priority Data

Nov. 30, 2007 (GB) ..... 0723487.5

(51) Int. Cl.
*H01J 49/02* (2006.01)

(52) U.S. Cl. ..... 250/283; 250/397

(58) Field of Classification Search ..... 250/283, 250/281, 282, 397

See application file for complete search history.

(56) References Cited

U.S. PATENT DOCUMENTS 6,642,516 B1 11/2003 Hansen et al.
7,294,954 B2 * 11/2007 Syms ..... 313/103 CM
2005/0109930 A1 5/2005 Hill, Jr.

FOREIGN PATENT DOCUMENTS

WO 2007061235 5/2007
WO 2007100029 9/2007

OTHER PUBLICATIONS

Bouclier, R. et al; The Gas Electron Multiplier (GEM); IEEE Transactions on Nuclear Science, IEEE, vol. 44, No. 3, Jun. 1, 1997.
Sauli, F.; GEM: A New Concept for Electron Amplification in Gas Detectors; Nuclear Instruments and Methods in Physics Research A 386 (1997) 531-534.

* cited by examiner

*Primary Examiner* — Kiet T Nguyen
(74) *Attorney, Agent, or Firm* — Diederiks & Whitelaw PLC

(57) ABSTRACT

A mass spectrometer is disclosed comprising a Gas Electron Multiplier ion detector. The ion detector comprises three gas electron multiplier stages GEM1, GEM2, GEM3 wherein a counter electrode (12) is arranged adjacent the first electron multiplier stage GEM1.

15 Claims, 9 Drawing Sheets

GAS ELECTRON MULTIPLIER DETECTOR

CROSS REFERENCE TO RELATED APPLICATIONS

This application is the National Stage of International Application No. PCT/GB2008/003969, filed on Dec. 1, 2008, which claims priority to and benefit of U.S. Provisional Patent Application Ser. 61/013,679, filed on Dec. 14, 2007, and priority to and benefit of United Kingdom Patent Application No. 0723487.5, filed Nov. 30, 2007. The entire contents of these applications are incorporated herein by reference.

The present invention relates to a Gas Electron Multiplier ion detector which is used in the detector system of a mass spectrometer or ion mobility spectrometer. The present invention also relates to a method of detecting ions and a method of mass spectrometry.

Gaseous avalanche electron multipliers for the detection of ionising radiation are known and are often referred to as Gas Electron Multipliers ("GEM") detectors. Gas Electron Multiplier detectors represent a significant improvement over conventional detectors such as multi-wire proportional counters and micro-patterned detectors. One advantage of known Gas Electron Multiplier detectors is that they can be moulded into different shapes. Spatial information can also easily be obtained. Multiple stages can also be stacked together to produce a low cost detector which has a significantly increased gain.

It is known to use Gas Electron Multipliers in what is commonly referred to as a triple GEM configuration. The detector is used in high energy physics experiments including high energy particle radiation detection and tracking at moderate (sub-mm) resolutions. Gas Electron Multipliers may also be used in single-photon imaging such as in Ring Imaging Cherenkov ("RICH") detectors. It is also known to use Gas Electron Multiplier ion detectors in moderate-resolution, beta, gamma-ray, x-ray, synchrotron and neutron imaging. A further application for Gas Electron Multipliers is in two-phase and high-pressure cryogenic detectors for solar neutrino and coherent neutrino scattering experiments. A yet further use of Gas Electron Multipliers is in Time Projection Chambers ("TPC").

Gas Electron Multiplier detectors have not been used to detect low energy ions, since low energy positive ions are repelled from the entrance to the Gas Electron Multiplier device and hence are not detected. In analytical instrumentation the majority of analyte ions of interest are positively charged and hence it is desired to have instrumentation for the analysis and detection of analyte ions which is able to detect low energy positive ions.

It is known to use an ion mobility spectrometer to detect and identify low concentrations of chemicals based upon the differential migration of gas phase ions through a homogeneous electric field. Ion mobility spectrometers have become a routine tool for the field detection of explosives, drugs and chemical weapons and have found utility as a research tool where they have an increasing role in the analysis of biological materials, in particular in proteomics and metabolomics. Various different forms of ion mobility spectrometers are known which may be operated under a range of operating conditions. Ion mobility spectrometers are often operated at pressures ranging from atmospheric pressure down to a few tenths of a milli-bar. A Faraday cup or Faraday plate detector is commonly used as the detector within an ion mobility spectrometer since Faraday cup or Faraday plate detectors are one of the few forms of ion detector which are capable of operating at relatively high sub-atmospheric pressures. By way of contrast, ion detectors as used in a Time of Flight mass spectrometer require a high vacuum.

It is known to couple an ion mobility spectrometer with a mass spectrometer (MS) so that ions are firstly separated according to their ion mobility and are then mass analysed and detected by the mass spectrometer or mass analyser. The detection systems typically utilised in conventional mass spectrometers have a large gain in order to detect single ion events and typically require high vacuum (low pressure) e.g. of the order of $10^{-5}$ mbar or lower. Examples of known ion detectors as used in mass spectrometry instrumentation include electron multiplier (e.g. multi channel plate and single channel channeltron) detectors, conversion dynodes with a scintillator or phosphor, and photon multipliers.

The detectors employed in mass spectrometry instrumentation are capable of detecting a single ion. However, conventional Faraday cup detectors whether used at high pressure with an ion mobility spectrometer or used at high vacuum in a mass spectrometer typically require a minimum of 1000 ions in well shielded static or immobile instrumentation. Approximately $10^4$ or more ions are required for handheld or portable instruments. This is mainly a consequence of the electronic noise, in particular the Johnson noise associated with high value resistors, and the lack of any noise free electronic amplifiers to detect the ion signal.

Faraday cup detectors also typically have a relatively slow response time due to the use of high value resistors and unavoidable capacitance in the system.

It is desired to provide an improved ion detector for use with an ion mobility spectrometer or mass spectrometer.

According to an aspect of the present invention there is provided a mass spectrometer comprising a Gas Electron Multiplier ion detector.

The mass spectrometer preferably comprises a device arranged and adapted either:

(a) to maintain the ion detector at a pressure selected from the group consisting of: (i) <1000 mbar; (ii) <100 mbar; (iii) <10 mbar; (iv) <1 mbar; (v) <0.1 mbar; (vi) <0.01 mbar; (vii) <0.001 mbar; (viii) <0.0001 mbar; and (ix) <0.00001 mbar; and/or (b) to maintain the ion detector in a mode of operation at a pressure selected from the group consisting of: (i) >1000 mbar; (ii) >100 mbar; (iii) >10 mbar; (iv) >1 mbar; (v) >0.1 mbar; (vi) >0.01 mbar; (vii) >0.001 mbar; and (viii) >0.0001 mbar and/or (c) to maintain the ion detector in a mode of operation at a pressure selected from the group consisting of: (i) 0.0001-0.001 mbar; (ii) 0.001-0.01 mbar; (iii) 0.01-0.1 mbar; (iv) 0.1-1 mbar; (v) 1-10 mbar; (vi) 10-100 mbar; and (vii) 100-1000 mbar.

The ion detector is preferably arranged and adapted to detect ions having an energy selected from the group consisting of: (i) <1 eV; (ii) 1-5 eV; (iii) 5-10 eV; (iv) 10-15 eV; (v) 15-20 eV; (vi) 20-25 eV; (vii) 25-30 eV; (viii) 30-35 eV; (ix) 35-40 eV; (x) 40-45 eV; (xi) 45-50 eV; (xii) 50-55 eV; (xiii) 55-60 eV; (xiv) 60-65 eV; (xv) 65-70 eV; (xvi) 70-75 eV; (xvii) 75-80 eV; (xviii) 80-85 eV; (xix) 85-90 eV; (xx) 90-95 eV; (xxi) 95-100 eV; (xxii) 100-105 eV; (xxiii) 105-110 eV; (xxiv) 110-115 eV; (xxv) 115-120 eV; (xxvi) 120-125 eV; (xxvii) 125-130 eV; (xxviii) 130-135 eV; (xxix) 135-140 eV; (xxx) 140-145 eV; (xxxi) 145-150 eV; (xxxii) 150-155 eV; (xxxiii) 155-160 eV; (xxxiv) 160-165 eV; (xxxv) 165-170 eV; (xxxvi) 170-175 eV; (xxxvii) 175-180 eV; (xxxviii) 180-185 eV; (xxxix) 185-190 eV; (xl) 190-195 eV; (xli) 195-200 eV; and (xlii) >200 eV. It will be apparent that the preferred ion detector is arranged and adapted to detect ions having a significantly lower energy that conventional radiation detectors which may be arranged to detect particles having energies in the range keV to MeV.

The ion detector preferably comprises a first foil layer, a first substrate or a first gas electron multiplier stage. According to an embodiment 0-5%, 5-10%, 10-15%, 15-20%, 20-25%, 25-30%, 30-35%, 35-40%, 40-45%, 45-50%, 50-55%, 55-60%, 60-65%, 65-70%, 70-75%, 75-80%, 80-85%, 85-90%, 90-95% or 95-100% of an upper and/or lower surface of the first foil layer, the first substrate or the first gas electron multiplier stage may comprise a first surface layer or coating which is either:

(i) arranged and adapted to enhance the yield of secondary ions and/or electrons; and/or (ii) a photocathode layer which is arranged and adapted to receive photons and to release photoelectrons.

The ion detector preferably comprises a second foil layer, a second substrate or a second gas electron multiplier stage. According to an embodiment 0-5%, 5-10%, 10-15%, 15-20%, 20-25%, 25-30%, 30-35%, 35-40%, 40-45%, 45-50%, 50-55%, 55-60%, 60-65%, 65-70%, 70-75%, 75-80%, 80-85%, 85-90%, 90-95% or 95-100% of an upper and/or lower surface of the second foil layer, the second substrate or the second gas electron multiplier stage may comprise a second surface layer or coating which is either:

(i) arranged and adapted to enhance the yield of secondary ions and/or electrons; and/or (ii) a photocathode layer which is arranged and adapted to receive photons and to release photoelectrons.

The ion detector preferably comprises a third foil layer, a third substrate, or a third gas electron multiplier stage. According to an embodiment 0-5%, 5-10%, 10-15%, 15-20%, 20-25%, 25-30%, 30-35%, 35-40%, 40-45%, 45-50%, 50-55%, 55-60%, 60-65%, 65-70%, 70-75%, 75-80%, 80-85%, 85-90%, 90-95% or 95-100% of an upper and/or lower surface of the third foil layer, the third substrate or the third gas electron multiplier stage may comprise a third surface layer or coating which is either:

(i) arranged and adapted to enhance the yield of secondary ions and/or electrons; and/or (ii) a photocathode layer which is arranged and adapted to receive photons and to release photoelectrons.

The ion detector preferably comprises a fourth foil layer, a fourth substrate or a fourth gas electron multiplier stage. According to an embodiment 0-5%, 5-10%, 10-15%, 15-20%, 20-25%, 25-30%, 30-35%, 35-40%, 40-45%, 45-50%, 50-55%, 55-60%, 60-65%, 65-70%, 70-75%, 75-80%, 80-85%, 85-90%, 90-95% or 95-100% of an upper and/or lower surface of the fourth foil layer, the fourth substrate or the fourth gas electron multiplier stage may comprise a fourth surface layer or coating which is either:

(i) arranged and adapted to enhance the yield of secondary ions and/or electrons; and/or (ii) a photocathode layer which is arranged and adapted to receive photons and to release photoelectrons.

The first surface layer or coating and/or the second surface layer or coating and/or the third surface layer or coating and/or the fourth surface layer or coating is preferably selected from the group consisting of: (i) caesium iodide (CsI); (ii) caesium telluride (CsTe); (iii) αCH:N, amorphous carbon or Diamond Like Carbon ("DLC"); (iv) copper; (v) aluminium; (vi) magnesium oxide (MgO); (vii) magnesium fluoride ($MgF_2$); and (viii) tungsten.

According to an embodiment the first foil layer, the first substrate or the first gas electron multiplier stage and/or the second foil layer, the second substrate or the second gas electron multiplier stage and/or the third foil layer, the third substrate or the third gas electron multiplier stage and/or the fourth foil layer, the fourth substrate or the fourth gas electron multiplier stage are preferably fabricated from a material selected from the group consisting of: (i) Kapton®; (ii) Polytetrafluoroethylene; (iii) a ceramic; (iv) a glass; (v) a plastics material; (vi) an insulating material; and (vii) a polymer sheet. The foil layers may also be made from the same materials which are used to manufacture printed circuit boards.

According to an embodiment the first foil layer, the first substrate or the first gas electron multiplier stage and/or the second foil layer, the second substrate or the second gas electron multiplier stage and/or the third foil layer, the third substrate or the third gas electron multiplier stage and/or the fourth foil layer, the fourth substrate or the fourth gas electron multiplier stage preferably have a thickness selected from the group consisting of: (i) <1 μm; (ii) 1-5 μm; (iii) 5-10 μm; (iv) 10-15 μm; (v) 15-20 μm; (vi) 20-25 μm; (vii) 25-30 μm; (viii) 30-35 μm; (ix) 35-40 μm; (x) 40-45 μm; (xi) 45-50 μm; (xii) 50-55 μm; (xiii) 55-60 μm; (xiv) 60-65 μm; (xv) 65-70 μm; (xvi) 70-75 μm; (xvii) 75-80 μm; (xviii) 80-85 μm; (xix) 85-90 μm; (xx) 90-95 μm; (xxi) 95-100 μm; (xxii) 100-200 μm; (xxiii) 200-300 μm; (xxiv) 300-400 μm; (xxv) 400-500 μm; (xxvi) 500-600 μm; (xxvii) 600-700 μm; (xxviii) 700-800 μm; (xxix) 800-900 μm; (xxx) 900-1000 μm; (xxxi) 1-2 mm; (xxxii) 2-3 mm; (xxxiii) 3-4 mm; (xxxiv) 4-5 mm; and (xxxv) >5 mm. Although the preferred thickness of the foil layers is approximately 50 μm, according to an alternative embodiment a relatively thick (e.g. 1 mm) substrate layer may be provided in at least one of the Gas Electron Multiplier stages.

According to an embodiment the first foil layer, the first substrate or the first gas electron multiplier stage and/or the second foil layer, the second substrate or the second gas electron multiplier stage and/or the third foil layer, the third substrate or the third gas electron multiplier stage and/or the fourth foil layer, the fourth substrate or the fourth gas electron multiplier stage are preferably coated on an upper and/or lower surface with a copper or other metallic or conductive coating or layer.

According to an embodiment the first foil layer, the first substrate or the first gas electron multiplier stage and/or the second foil layer, the second substrate or the second gas electron multiplier stage and/or the third foil layer, the third substrate or the third gas electron multiplier stage and/or the fourth foil layer, the fourth substrate or the fourth gas electron multiplier stage are preferably coated on an upper and/or lower surface with a copper or other metallic or conductive coating having a thickness selected from the group consisting of: (i) <1 μm; (ii) 1-5 μm; (iii) 5-10 μm; (iv) 10-15 μm; (v) 15-20 μm; (vi) 20-25 μm; (vii) 25-30 μm; (viii) 30-35 μm; (ix) 35-40 μm; (x) 40-45 μm; (xi) 45-50 μm; and (xii) >50 μm.

According to an embodiment the first foil layer, the first substrate or the first gas electron multiplier stage and/or the second foil layer, the second substrate or the second gas electron multiplier stage and/or the third foil layer, the third substrate or the third gas electron multiplier stage and/or the fourth foil layer, the fourth substrate or the fourth gas electron multiplier stage preferably comprise a plurality of holes having a maximum and/or minimum diameter selected from the group consisting of: (i) <1 μm; (ii) 1-5 μm; (iii) 5-10 μm; (iv) 10-15 μm; (v) 15-20 μm; (vi) 20-25 μm; (vii) 25-30 μm; (viii) 30-35 μm; (ix) 35-40 μm; (x)40-45 μm; (xi) 45-50 μm; (xii) 50-55 μm; (xiii) 55-60 μm; (xiv) 60-65 μm; (xv) 65-70 μm; (xvi) 70-75 μm; (xvii) 75-80 μm; (xviii) 80-85 μm; (xix) 85-90 μm; (xx) 90-95 μm; (xxi) 95-100 μm; and (xxii) >100 μm.

The first foil layer, the first substrate or the first gas electron multiplier stage and/or the second foil layer, the second substrate or the second gas electron multiplier stage and/or the third foil layer, the third substrate or the third gas electron multiplier stage and/or the fourth foil layer, the fourth substrate or the fourth gas electron multiplier stage preferably comprise a plurality of holes having a tubular, conical, biconical or concave channel.

The first foil layer, the first substrate or the first gas electron multiplier stage and/or the second foil layer, the second substrate or the second gas electron multiplier stage and/or the third foil layer, the third substrate or the third gas electron multiplier stage and/or the fourth foil layer, the fourth substrate or the fourth gas electron multiplier stage preferably comprise a plurality of holes having a pitch selected from the group consisting of: (i) <1 μm; (ii) 1-5 μm; (iii) 5-10 μm; (iv) 10-15 μm; (v) 15-20 μm; (vi) 20-25 μm; (vii) 25-30 μm; (viii) 30-35 μm; (ix) 35-40 μm; (x) 40-45 μm; (xi) 45-50 μm; (xii) 50-55 μm; (xiii) 55-60 μm; (xiv) 60-65 μm; (xv) 65-70 μm; (xvi) 70-75 μm; (xvii) 75-80 μm; (xviii) 80-85 μm; (xix) 85-90 μm; (xx) 90-95 μm; (xxi) 95-100 μm; (xxii) 100-110 μm; (xxiii) 110-120 μm; (xxiv) 120-130 μm; (xxv) 130-140 μm; (xxvi) 140-150 μm; (xxvii) 150-160 μm; (xxviii) 160-170 μm; (xxix) 170-180 μm; (xxx) 180-190 μm; (xxxi) 190-200 μm; and (xxxii) >200 μm.

A voltage or potential difference is preferably maintained between an upper and lower surface of the first foil layer, the first substrate or the first gas electron multiplier stage, wherein the voltage or potential difference is preferably selected from the group consisting of: (i) <50 V; (ii) 50-100 V; (iii) 100-150 V; (iv) 150-200 V; (v) 200-250 V; (vi) 250-300 V; (vii) 300-350 V; (viii) 350-400 V; (ix) 400-450 V; (x) 450-500 V; (xi) 500-550 V; (xii) 550-600 V; (xiii) 600-650 V; (xiv) 650-700 V; (xv) 700-750 V; (xvi) 750-800 V; (xvii) 800-850 V; (xviii) 850-900 V; (xix) 900-950 V; (xx) 950-1000 V; and (xxi) >1000 V.

A voltage or potential difference is preferably maintained between an upper and lower surface of the second foil layer, the second substrate or the second gas electron multiplier stage, wherein the voltage or potential difference is preferably selected from the group consisting of: (i) <50 V; (ii) 50-100 V; (iii) 100-150 V; (iv) 150-200 V; (v) 200-250 V; (vi) 250-300 V; (vii) 300-350 V; (viii) 350-400 V; (ix) 400-450 V; (x)450-500 V; (xi) 500-550 V; (xii) 550-600 V; (xiii) 600-650 V; (xiv) 650-700 V; (xv) 700-750 V; (xvi) 750-800 V; (xvii) 800-850 V; (xviii) 850-900 V; (xix) 900-950 V; (xx) 950-1000 V; and (xxi) >1000 V.

A voltage or potential difference is preferably maintained between an upper and lower surface of the third foil layer, the third substrate or the third gas electron multiplier stage, wherein the voltage or potential difference is preferably selected from the group consisting of: (i) <50 V; (ii) 50-100 V; (iii) 100-150 V; (iv) 150-200 V; (v) 200-250 V; (vi) 250-300 V; (vii) 300-350 V; (viii) 350-400 V; (ix) 400-450 V; (x) 450-500 V; (xi) 500-550 V; (xii) 550-600 V; (xiii) 600-650 V; (xiv) 650-700 V; (xv) 700-750 V; (xvi) 750-800 V; (xvii) 800-850 V; (xviii) 850-900 V; (xix) 900-950 V; (xx) 950-1000 V; and (xxi) >1000 V.

A voltage or potential difference is preferably maintained between an upper and lower surface of the fourth foil layer, the fourth substrate or the fourth gas electron multiplier stage, wherein the voltage or potential difference is preferably selected from the group consisting of: (i) <50 V; (ii) 50-100 V; (iii) 100-150 V; (iv) 150-200 V; (v) 200-250 V; (vi) 250-300 V; (vii) 300-350 V; (viii) 350-400 V; (ix) 400-450 V; (x) 450-500 V; (xi) 500-550 V; (xii) 550-600 V; (xiii) 600-650 V; (xiv) 650-700 V; (xv) 700-750 V; (xvi) 750-800 V; (xvii) 800-850 V; (xviii) 850-900 V; (xix) 900-950 V; (xx) 950-1000 V; and (xxi) >1000 V.

An electric field is preferably maintained into holes in the first foil layer, the first substrate or the first gas electron multiplier stage and/or into holes in the second foil layer, the second substrate or the second gas electron multiplier stage and/or into holes in the third foil layer, the third substrate or the third gas electron multiplier stage and/or into holes in the fourth foil layer, the fourth substrate or the fourth gas electron multiplier stage, wherein the electric field is selected from the group consisting of: (i) <10 kV/cm; (ii) 10-20 kV/cm; (iii) 20-30 kV/cm; (iv) 30-40 kV/cm; (v) 40-50 kV/cm; (vi) 50-60 kV/cm; (vii) 60-70 kV/cm; (viii) 70-80 kV/cm; (ix) 80-90 kV/cm; (x) 90-100 kV/cm; (xi) 100-150 kV/cm; (xii) 150-200 kV/cm; (xiii) 200-250 kV/cm; (xiv) 250-300 kV/cm; (xv) 300-350 kV/cm; (xvi) 350-400 kV/cm; (xvii) 400-450 kV/cm; (xviii) 450-500 kV/cm; and (xix) >500 kV/cm.

The centre-to-centre spacing between the first foil layer, the first substrate or the first gas electron multiplier stage and/or the second foil layer, the second substrate or the second gas electron multiplier stage and/or the third foil layer, the third substrate or the third gas electron multiplier stage and/or the fourth foil layer, the fourth substrate or the fourth gas electron multiplier stage is preferably selected from the group consisting of: (i) <0.2 mm; (ii) 0.2-0.4 mm; (iii) 0.4-0.6 mm; (iv) 0.6-0.8 mm; (v) 0.8-1.0 mm; (vi) 1.0-1.2 mm; (vii) 1.2-1.4 mm; (viii) 1.4-1.6 mm; (ix) 1.6-1.8 mm; (x) 1.8-2.0 mm; (xi) 2.0-2.2 mm; (xii) 2.2-2.4 mm; (xiii) 2.4-2.6 mm; (xiv) 2.6-2.8 mm; (xv) 2.8-3.0 mm; (xvi) 3.0-3.2 mm; (xvii) 3.2-3.4 mm; (xviii) 3.4-3.6 mm; (xix) 3.6-3.8 mm; (xx) 3.8-4.0 mm; (xxi) 4.0-4.2 mm; (xxii) 4.2-4.4 mm; (xxiii) 4.4-4.6 mm; (xxiv) 4.6-4.8 mm; (xxv) 4.8-5.0 mm; (xxvi) 5.0-6.0 mm; (xxvii) 6.0-7.0 mm; (xxviii) 7.0-8.0 mm; (xxix) 8.0-9.0 mm; (xxx) 9.0-10.0 mm; and (xxxi) >10.0 mm.

A charge blocking mesh electrode may be provided between the first foil layer, the first substrate or the first gas electron multiplier stage and the second foil layer, the second substrate or the second gas electron multiplier stage.

A charge blocking mesh electrode may be provided between the second foil layer, the second substrate or the second gas electron multiplier stage and the third foil layer, the third substrate or the third gas electron multiplier stage.

A charge blocking mesh electrode may be provided between the third foil layer, the third substrate or the third gas electron multiplier stage and the fourth foil layer, the fourth substrate or the fourth gas electron multiplier stage.

One or more anodes and/or one or more cathodes may be provided on an upper and/or lower surface of the first foil layer, the first substrate or the first gas electron multiplier stage.

One or more anodes and/or one or more cathodes are preferably provided on an upper and/or lower surface of the second foil layer, the second substrate or the second gas electron multiplier stage.

One or more anodes and/or one or more cathodes are preferably provided on an upper and/or lower surface of the third foil layer, the third substrate or the third gas electron multiplier stage.

One or more anodes and/or one or more cathodes are preferably provided on an upper and/or lower surface of the fourth foil layer, the fourth substrate or the fourth gas electron multiplier stage.

The ion detector preferably comprises one or more electrodes, counter electrodes or cathodes arranged either:

(i) adjacent and/or facing and/or opposed to the first foil layer, the first substrate or the first gas electron multiplier stage; and/or (ii) in a drift or input region of the ion detector; and/or (iii) to receive analyte cations and to release secondary electrons and/or secondary anions and/or secondary cations.

The one or more electrodes, counter electrodes or cathodes preferably comprise:

(i) one or more planar electrodes; and/or (ii) one or more grid or mesh electrodes; and/or (iii) one or more electrodes having one or more apertures through which ions or analyte cations may be transmitted in use.

According to an embodiment ions may be transmitted through a grid cathode electrode.

According to an embodiment 0-5%, 5-10%, 10-15%, 15-20%, 20-25%, 25-30%, 30-35%, 35-40%, 40-45%, 45-50%, 50-55%, 55-60%, 60-65%, 65-70%, 70-75%, 75-80%, 80-85%, 85-90%, 90-95% or 95-100% of an upper and/or lower surface of the one or more electrodes, counter electrodes or cathodes may comprise a surface layer or coating which is either:

(i) arranged and adapted to enhance the yield of secondary ions and/or electrons; and/or (ii) a photocathode layer which is arranged and adapted to receive photons and to release photoelectrons.

The surface coating is preferably selected from the group consisting of: (i) caesium iodide (CsI); (ii) caesium telluride (CsTe); (iii) αCH:N, amorphous carbon or Diamond Like Carbon ("DLC"); (iv) copper; (v) aluminium; (vi) magnesium oxide (MgO); (vii) magnesium fluoride ($MgF_2$); and (viii) tungsten.

According to an embodiment:

(i) the one or more electrodes, counter electrodes or cathodes may be maintained, in use, at a negative potential relative to an upper and/or lower surface of the first foil layer, the first substrate or the first gas electron multiplier stage; and/or (ii) positively charged analyte ions may be accelerated away, in use, from the first foil layer, the first substrate or the first gas electron multiplier stage and are accelerated towards the one or more electrodes, counter electrodes or cathodes; and/or (iii) positively charged analyte ions may be caused, in use, to impact the surface of the one or more electrodes, counter electrodes or cathodes and to yield secondary anions and/or secondary cations and/or secondary electrons; and/or (iv) at least some secondary anions and/or secondary cations and/or secondary electrons are preferably accelerated, in use, through one or more holes in the first foil layer, the first substrate or the first gas electron multiplier stage; and/or (v) at least some secondary anions and/or secondary cations and/or the secondary electrons emitted from the one or more electrodes, counter electrodes or cathodes are preferably caused, in use, to impact the surface of the first foil layer, the first substrate or the first gas electron multiplier stage and to yield further electrons; and/or (vi) negatively charged analyte ions are preferably caused, in use, to be accelerated through one or more holes in the first foil layer, the first substrate or the first gas electron multiplier stage; and/or (vii) electrons are preferably directed onto one or more anodes arranged on an upper and/or lower surface of the first foil layer, the first substrate or the first gas electron multiplier stage whereupon a plurality of electrons and/or photons are produced; and/or (viii) electrons are preferably directed onto one or more anodes arranged on an upper and/or lower surface of the second foil layer, the second substrate or the second gas electron multiplier stage whereupon a plurality of electrons and/or photons are produced; and/or (ix) electrons are preferably directed onto one or more anodes arranged on an upper and/or lower surface of the third foil layer, the third substrate or the third gas electron multiplier stage whereupon a plurality of electrons and/or photons are produced; and/or (x) electrons are preferably directed onto one or more anodes arranged on an upper and/or lower surface of the fourth foil layer, the fourth substrate or the fourth gas electron multiplier stage whereupon a plurality of electrons and/or photons are produced; and/or (xi) avalanche generated photons are preferably caused to pass through a charge blocking mesh electrode located between the first foil layer, the first substrate or the first gas electron multiplier stage and the second foil layer, the second substrate or the second gas electron multiplier stage; and/or (xii) avalanche generated photons are preferably caused to pass through a charge blocking mesh electrode located between the second foil layer, the second substrate or the second gas electron multiplier stage and the third foil layer, the third substrate or the third gas electron multiplier stage; and/or (xiii) avalanche generated photons are preferably caused to pass through a charge blocking mesh electrode located between the third foil layer, the third substrate or the third gas electron multiplier stage and the fourth foil layer, the fourth substrate or the fourth gas electron multiplier stage; and/or (xiv) positively charged analyte ions are preferably caused, in use, to impact the surface of the one of more electrodes, counter electrodes or cathodes with a velocity selected from the group consisting of: (i) <1 mm/μs; (ii) 1-5 mm/μs; (iii) 5-10 mm/μs; (iv) 10-15 mm/μs; (v) 15-20 mm/μs; (vi) 20-25 mm/μs; (vii) 25-30 mm/μs; (viii) 30-35 mm/μs; (ix) 35-40 mm/μs; (x) 40-45 mm/μs; (xi) 45-50 mm/μs; (xii) 50-55 mm/μs; (xiii) 55-60 mm/μs; (xiv) 60-65 mm/μs; (xv) 65-70 mm/μs; (xvi) 70-75 mm/μs; (xvii) 75-80 mm/μs; (xviii) 80-85 mm/μs; (xix) 85-90 mm/μs; (xx) 90-95 mm/μs; (xxi) 95-100 mm/μs; and (xxii) >100 mm/μs.

The ion detector preferably further comprises:

(i) one or more readout electrodes; and/or (ii) one or more photo-multiplier tubes ("PMT"); and/or (iii) one or more charge coupled detectors ("CCD").

The one or more readout electrodes and/or one or more photo-multiplier tubes ("PMT") and/or one or more charge coupled detectors ("CCD") are preferably arranged downstream of the last foil layer, substrate or gas electron multiplier stage and are preferably arranged to detect electrons and/or photons emitted from the last foil electrode or Gas Electron Multiplier stage. The one or more readout electrodes and/or one or more photo-multiplier tubes ("PMT") and/or one or more charge coupled detectors ("CCD") are preferably connected to a readout anode and/or readout electronics.

The mass spectrometer preferably further comprises either:

(a) an ion source arranged, wherein the ion source is selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; and (xx) a Glow Discharge ("GD") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells, wherein the one or more collision, fragmentation or reaction cells are selected from the group consisting of: (i) a Collisional Induced Dissociation ("CID") fragmentation device; (ii) a Surface Induced Dissociation ("SID") fragmentation device; (iii) an Electron Transfer Dissociation ("ETD")' fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) magnetic sector mass analyser; (vii) a Time of Flight mass analyser; (viii) an orthogonal acceleration Time of Flight mass analyser; and (ix) a linear acceleration Time of Flight mass analyser; and/or (h) one or more energy analysers or electrostatic energy analysers; and/or (i) one or more ion detectors; and/or (j) one or more mass filters, wherein the one or more mass filters are selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wein filter; and/or (k) a device for converting a substantially continuous ion beam into a pulsed ion beam.

According to an embodiment the mass spectrometer may comprise:

a C-trap; and a mass analyser;

wherein in a first mode of operation ions are transmitted to the C-trap and are then injected into the mass analyser; and wherein in a second mode of operation ions are transmitted to the C-trap and then to a collision, fragmentation or reaction cell or an Electron Transfer Dissociation and/or Proton Transfer Reaction device wherein at least some ions are fragmented into fragment ions and/or reacted to form product ions, and wherein the fragment ions and/or the product ions are then transmitted to the C-trap before being injected into the mass analyser.

The ion detector preferably has a gain selected from the group consisting of: (i) <10; (ii) 10-100; (iii) 100-1000, (iv) $10^3$-$10^4$; (v) $10^4$-$10^5$; (vi) $10^5$-$10^6$; (vii) $10^6$-$10^7$; and (viii) $>10^7$.

According to another aspect of the present invention there is provided a method of mass spectrometry comprising:

using a Gas Electron Multiplier ion detector to detect ions.

According to another aspect of the present invention there is provided apparatus comprising:

an ion mobility spectrometer comprising a first plurality of electrodes and/or an ion fragmentation or reaction device comprising a second plurality of electrodes; and a Gas Electron Multiplier ion detector which is arranged and adapted to detect ions which emerge from the ion mobility spectrometer and/or from the ion fragmentation or reaction device.

According to an embodiment:

(a) the ion mobility spectrometer is arranged to cause ions to separate temporally according to their ion mobility; and/or (b) the ion mobility spectrometer comprises a Field Asymmetric Ion Mobility Spectrometer ("FAIMS") which is arranged and adapted to cause ions to separate temporally according to their rate of change of ion mobility with electric field strength; and/or (c) in use a buffer, reaction or fragmentation gas is provided within the ion mobility spectrometer and/or the ion fragmentation or reaction device; and/or (d) the ion mobility spectrometer comprises a gas phase electrophoresis device; and/or (e) the ion mobility spectrometer comprises a drift tube and one or more electrodes for maintaining an axial DC voltage gradient along at least a portion of the drift tube; and/or (f) the ion mobility spectrometer and/or the ion fragmentation or reaction device comprises one or more multipole rod sets; and/or (g) the ion mobility spectrometer and/or the ion fragmentation or reaction device comprises one or more quadrupole, hexapole, octapole or higher order rod sets; and/or (h) the ion mobility spectrometer and/or the ion fragmentation or reaction device comprises one or more quadrupole, hexapole, octapole or higher order rod sets, wherein the one or more multipole rod sets are axially segmented or comprise a plurality of axial segments; and/or (i) the ion mobility spectrometer and/or the ion fragmentation or reaction device comprises at least 5, 10, 15, 20, 25, 30, 35, 40, 45, 50, 55, 60, 65, 70, 75, 80, 85, 90, 95 or 100 electrodes; and/or (j) at least 5%, 10%, 15%, 20%, 25%, 30%, 35%, 40%, 45%, 50%, 55%, 60%, 65%, 70%, 75%, 80%, 85%, 90%, 95% or 100% of the first electrodes and/or at least 5%, 10%, 15%, 20%, 25%, 30%, 35%, 40%, 45%, 50%, 55%, 60%, 65%, 70%, 75%, 80%, 85%, 90%, 95% or 100% of the second electrodes have apertures through which ions are transmitted in use; and/or (k) at least 5%, 10%, 15%, 20%, 25%, 30%, 35%, 40%, 45%, 50%, 55%, 60%, 65%, 70%, 75%, 80%, 85%, 90%, 95% or 100% of the first electrodes and/or at least 5%, 10%, 15%, 20%, 25%, 30%, 35%, 40%, 45%, 50%, 55%, 60%, 65%, 70%, 75%, 80%, 85%, 90%, 95% or 100% of the second electrodes have apertures which are of substantially the same size or area; and/or (l) at least 5%, 10%, 15%, 20%, 25%, 30%, 35%, 40%, 45%, 50%, 55%, 60%, 65%, 70%, 75%, 80%, 85%, 90%, 95% or 100% of the first electrodes have apertures which are of substantially the same first size or first area and/or at least 5%, 10%, 15%, 20%, 25%, 30%, 35%, 40%, 45%, 50%, 55%, 60%, 65%, 70%, 75%, 80%, 85%, 90%, 95% or 100% of the first electrodes have apertures which are of substantially the same second different size or second different area; and/or (m) at least 5%, 10%, 15%, 20%, 25%, 30%, 35%, 40%, 45%, 50%, 55%, 60%, 65%, 70%, 75%, 80%, 85%, 90%, 95% or 100% of the second electrodes have apertures which are of substantially the same third size or third area and/or at least 5%, 10%, 15%, 20%, 25%, 30%, 35%, 40%, 45%, 50%, 55%, 60%, 65%, 70%, 75%, 80%, 85%, 90%, 95% or 100% of the second electrodes have apertures which are of substantially the same fourth different size or fourth different area; and/or (n) wherein at least 5%, 10%, 15%, 20%, 25%, 30%, 35%, 40%, 45%, 50%, 55%, 60%, 65%, 70%, 75%, 80%, 85%, 90%, 95% or 100% of the first electrodes and/or at least 5%, 10%, 15%, 20%, 25%, 30%, 35%, 40%, 45%, 50%, 55%, 60%, 65%, 70%, 75%, 80%, 85%, 90%, 95% or 100% of the second electrodes have apertures which become progressively larger and/or smaller in size or in area in a direction along the axis of the ion mobility spectrometer and/or ion fragmentation or reaction device; and/or (o) at least 5%, 10%, 15%, 20%, 25%, 30%, 35%, 40%, 45%, 50%, 55%, 60%, 65%, 70%, 75%, 80%, 85%, 90%, 95% or 100% of the first electrodes and/or at least 5%, 10%, 15%, 20%, 25%, 30%, 35%, 40%, 45%, 50%, 55%, 60%, 65%, 70%, 75%, 80%, 85%, 90%, 95% or 100% of the second electrodes have apertures having internal diameters or dimensions selected from the group consisting of: (i) ≦1.0 mm; (ii) ≦2.0 mm; (iii) ≦3.0 mm; (iv) ≦4.0 mm; (v) ≦5.0 mm; (vi) ≦6.0 mm; (vii) ≦7.0 mm; (viii) ≦8.0 mm; (ix) ≦9.0 mm; (x) ≦10.0 mm; and (xi) >10.0 mm; and/or (p) the ion mobility spectrometer and/or the ion fragmentation or reaction device comprises a plurality of plate or mesh electrodes and wherein at least some of the plate or mesh electrodes are arranged generally in the plane in which ions travel in use; and/or (q) the ion mobility spectrometer and/or the ion fragmentation or reaction device comprises a plurality of plate or mesh electrodes and wherein at least 5%, 10%, 15%, 20%, 25%, 30%, 35%, 40%, 45%, 50%, 55%, 60%, 65%, 70%, 75%, 80%, 85%, 90%, 95% or 100% of the plate or mesh electrodes are arranged generally in the plane in which ions travel in use; and/or (r) the ion mobility spectrometer and/or the ion fragmentation or reaction device comprises at least 2, 3, 4, 5, 6, 7, 8, 9, 10, 11, 12, 13, 14, 15, 16, 17, 18, 19, 20 or >20 plate or mesh electrodes; and/or (s) the ion mobility spectrometer, and/or the ion fragmentation or reaction device comprises at least 2, 3, 4, 5, 6, 7, 8, 9, 10, 11, 12, 13, 14, 15, 16, 17, 18, 19, 20 or >20 plate or mesh electrodes, wherein the plate or mesh electrodes are supplied with an AC or RF voltage wherein adjacent plate or mesh electrodes are supplied with opposite phases of the AC or RF voltage; and/or (t) the ion mobility spectrometer and/or the ion fragmentation or reaction device comprises a plurality of axial segments or at least 5, 10, 15, 20, 25, 30, 35, 40, 45, 50, 55, 60, 65, 70, 75, 80, 85, 90, 95 or 100 axial segments; and/or (u) the ion mobility spectrometer and/or the ion fragmentation or reaction device further comprises DC voltage means for maintaining a substantially constant DC voltage gradient along at least a portion of the axial length of the ion mobility spectrometer and/or the ion fragmentation or reaction device.

According to an embodiment:

(a) at least 1%, 5%, 10%, 20%, 30%, 40%, 50%, 60%, 70%, 80%, 90%, 95% or 100% of the first electrodes and/or at least 1%, 5%, 10%, 20%, 30%, 40%, 50%, 60%, 70%, 80%, 90%, 95% or 100% of the second electrodes have substantially circular, rectangular, square or elliptical apertures; and/or (b) at least 1%, 5%, 10%, 20%, 30%, 40%, 50%, 60%, 70%, 80%, 90%, 95% or 100% of the first electrodes have apertures which are substantially the same first size or which have substantially the same first area and/or at least 1%, 5%, 10%, 20%, 30%, 40%, 50%, 60%, 70%, 80%, 90%, 95% or 100% of the first electrodes have apertures which are substantially the same second different size or which have substantially the same second different area; and/or (c) at least 1%, 5%, 10%, 20%, 30%, 40%, 50%, 60%, 70%, 80%, 90%, 95% or 100% of the second electrodes have apertures which are substantially the same third size or which have substantially the same third area and/or at least 1%, 5%, 10%, 20%, 30%, 40%, 50%, 60%, 70%, 80%, 90%, 95% or 100% of the second electrodes have apertures which are substantially the same fourth different size or which have substantially the same fourth different area; and/or (d) at least 1%, 5%, 10%, 20%, 30%, 40%, 50%, 60%, 70%, 80%, 90%, 95% or 100% of the second electrodes and/or at least 1%, 5%, 10%, 20%, 30%, 40%, 50%, 60%, 70%, 80%, 90%, 95% or 100% of the second electrodes have apertures which become progressively larger and/or smaller in size or in area in a direction along the axis of the ion mobility spectrometer and/or the ion fragmentation or reaction device; and/or (e) at least 1%, 5%, 10%, 20%, 30%, 40%, 50%, 60%, 70%, 80%, 90%, 95% or 100% of the first electrodes and/or at least 1%, 5%, 10%, 20%, 30%, 40%, 50%, 60%, 70%, 80%, 90%, 95% or 100% of the second electrodes have apertures having internal diameters or dimensions selected from the group consisting of: (i) ≦1.0 mm; (ii) ≦2.0 mm; (iii) ≦3.0 mm; (iv) ≦4.0 mm; (v) ≦5.0 mm; (vi) ≦6.0 mm; (vii) ≦7.0 mm; (viii) ≦8.0 mm; (ix) ≦9.0 mm; (x) ≦10.0 mm; and (xi) >10.0 mm; and/or (f) at least 1%, 5%, 10%, 20%, 30%, 40%, 50%, 60%, 70%, 80%, 90%, 95% or 100% of the first electrodes and/or at least 1%, 5%, 10%, 20%, 30%, 40%, 50%, 60%, 70%, 80%, 90%, 95% or 100% of the second electrodes are spaced apart from one another by an axial distance selected from the group consisting of: (i) less than or equal to 5 mm; (ii) less than or equal to 4.5 mm; (iii) less than or equal to 4 mm; (iv) less than or equal to 3.5 mm; (v) less than or equal to 3 mm; (vi) less than or equal to 2.5 mm; (vii) less than or equal to 2 mm; (viii) less than or equal to 1.5 mm; (ix) less than or equal to 1 mm; (x) less than or equal to 0.8 mm; (xi) less than or equal to 0.6 mm; (xii) less than or equal to 0.4 mm; (xiii) less than or equal to 0.2 mm; (xiv) less than or equal to 0.1 mm; and (xv) less than or equal to 0.25 mm; and/or (g) at least some of the first electrodes and/or at least some of the second electrodes comprise apertures and wherein the ratio of the internal diameter or dimension of the apertures to the centre-to-centre axial spacing between adjacent electrodes is selected from the group consisting of: (i) <1.0; (ii) 1.0-1.2; (iii) 1.2-1.4; (iv) 1.4-1.6; (v) 1.6-1.8; (vi) 1.8-2.0; (vii) 2.0-2.2; (viii) 2.2-2.4; (ix) 2.4-2.6; (x) 2.6-2.8; (xi) 2.8-3.0; (xii) 3.0-3.2; (xiii) 3.2-3.4; (xiv) 3.4-3.6; (xv) 3.6-3.8; (xvi) 3.8-4.0; (xvii) 4.0-4.2; (xviii) 4.2-4.4; (xix) 4.4-4.6; (xx) 4.6-4.8; (xxi) 4.8-5.0; and (xxii) >5.0; and/or (h) the internal diameter of the apertures of the first electrodes and/or the internal diameter of the apertures of the second electrodes progressively increases or decreases and then progressively decreases or increases one or more times along the longitudinal axis of the ion mobility spectrometer and/or ion fragmentation or reaction device; and/or (i) the first electrodes and/or the second electrodes define a geometric volume, wherein the geometric volume is selected from the group consisting of: (i) one or more spheres; (ii) one or more oblate spheroids; (iii) one or more prolate spheroids; (iv) one or more ellipsoids; and (v) one or more scalene ellipsoids; and/or (j) the ion mobility spectrometer and/or the ion fragmentation or reaction device has a length selected from the group consisting of: (i) <20 mm; (ii) 20-40 mm; (iii) 40-60 mm; (iv) 60-80 mm; (v) 80-100 mm; (vi) 100-120 mm; (vii) 120-140 mm; (viii) 140-160 mm; (ix) 160-180 mm; (x) 180-200 mm; and (xi) >200 mm; and/or (k) the ion mobility spectrometer and/or the ion fragmentation or reaction device comprises at least: (i) 1-10 electrodes; (ii) 10-20 electrodes; (iii) 20-30 electrodes; (iv) 30-40 electrodes; (v) 40-50 electrodes; (vi) 50-60 electrodes; (vii) 60-70 electrodes; (viii) 70-80 electrodes; (ix) 80-90 electrodes; (x) 90-100 electrodes; (xi) 100-110 electrodes; (xii) 110-120 electrodes; (xiii) 120-130 electrodes; (xiv) 130-140 electrodes; (xv) 140-150 electrodes; (xvi) 150-160 electrodes; (xvii) 160-170 electrodes; (xviii) 170-180 electrodes; (xix) 180-190 electrodes; (xx) 190-200 electrodes; and (xxi) >200 electrodes; and/or (l) at least 1%, 5%, 10%, 20%, 30%, 40%, 50%, 60%, 70%, 80%, 90%, 95% or 100% of the first electrodes and/or at least 1%, 5%, 10%, 20%, 30%, 40%, 50%, 60%, 70%, 80%, 90%, 95% or 100% of the second electrodes have a thickness or axial length selected from the group consisting of: (i) less than or equal to 5 mm; (ii) less than or equal to 4.5 mm; (iii) less than or equal to 4 mm; (iv) less than or equal to 3.5 mm; (v) less than or equal to 3 mm; (vi) less than or equal to 2.5 mm; (vii) less than or equal to 2 mm; (viii) less than or equal to 1.5 mm; (ix) less than or equal to 1 mm; (x) less than or equal to 0.8 mm; (xi) less than or equal to 0.6 mm; (xii) less than or equal to 0.4 mm; (xiii) less than or equal to 0.2 mm; (xiv) less than or equal to 0.1 mm; and (xv) less than or equal to 0.25 mm; and/or (m) the pitch or axial spacing of the first electrodes and/or the second electrodes progressively decreases or increases one or more times along the longitudinal axis of the ion mobility spectrometer and/or the ion fragmentation or reaction device.

According to an embodiment the ion mobility spectrometer and/or the ion fragmentation or reaction device further comprise:

(i) a device for applying one or more DC voltages to the first electrodes and/or the second electrodes and/or to auxiliary electrodes so that in a mode of operation a substantially constant DC voltage gradient is maintained along at least a portion or at least 5%, 10%, 15%, 20%, 25%, 30%, 35%, 40%, 45%, 50%, 55%, 60%, 65%, 70%, 75%, 80%, 85%, 90%, 95% or 100% of the axial length of the ion mobility spectrometer and/or the ion fragmentation or reaction device; and/or (ii) a device for applying multi-phase RF voltages to the first electrodes and/or to the second electrodes in order to urge at least some ions along at least a portion or at least 5%, 10%, 15%, 20%, 25%, 30%, 35%, 40%, 45%, 50%, 55%, 60%, 65%, 70%, 75%, 80%, 85%, 90%, 95% or 100% of the axial length of the ion mobility spectrometer and/or the ion fragmentation or reaction device.

According to an embodiment the apparatus further comprises a first RF device arranged and adapted to apply a first AC or RF voltage having a first frequency and a first amplitude to at least some of the first electrodes and/or to at least some of the second electrodes such that, in use, ions are confined radially within the ion mobility spectrometer and/or the ion fragmentation or reaction device.

The first frequency is preferably selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The first amplitude is preferably selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak; and/or (c) in a mode of operation adjacent or neighbouring first electrodes and/or second electrodes are supplied with opposite phase of the first AC or RF voltage; and/or (d) the ion mobility spectrometer and/or the ion fragmentation or reaction device comprises 1-10, 10-20, 20-30, 30-40, 40-50, 50-60, 60-70, 70-80, 80-90, 90-100 or >100 groups of electrodes, wherein each group of electrodes comprises at least 1, 2, 3, 4, 5, 6, 7, 8, 9, 10, 11, 12, 13, 14, 15, 16, 17, 18, 19 or 20 electrodes and wherein at least 1, 2, 3, 4, 5, 6, 7, 8, 9, 10, 11, 12, 13, 14, 15, 16, 17, 18, 19 or 20 electrodes in each group are supplied with the same phase of the first AC or RF voltage.

The apparatus preferably further comprises a device arranged and adapted to progressively increase, progressively decrease, progressively vary, scan, linearly increase, linearly decrease, increase in a stepped, progressive or other manner or decrease in a stepped, progressive or other manner the first frequency by $x_1$ MHz over a time period $t_1$.

Preferably, $x_1$ is selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

Preferably, $t_1$ is selected from the group consisting of: (i) <1 ms; (ii) 1-10 ms; (iii) 10-20 ms; (iv) 20-30 ms; (v) 30-40 ms; (vi) 40-50 ms; (vii) 50-60 ms; (viii) 60-70 ms; (ix) 70-80 ms; (x)80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 ms; (xxi) 1-2 s; (xxii) 2-3 s; (xxiii) 3-4 s; (xxiv) 4-5 s; and (xxv)>5 s.

The apparatus may further comprise a device arranged and adapted to apply one or more transient DC voltages or potentials or one or more transient DC voltage or potential waveforms having a second amplitude, height or depth to the first electrodes and/or to the second electrodes in order to urge at least some ions along at least a portion or at least 5%, 10%, 15%, 20%, 25%, 30%, 35%, 40%, 45%, 50%, 55%, 60%, 65%, 70%, 75%, 80%, 85%, 90%, 95% or 100% of the axial length of the ion mobility spectrometer and/or the ion fragmentation or reaction device.

According to an embodiment the apparatus may further comprise a device arranged and adapted to vary, progressively increase, progressively decrease, progressively vary, scan, linearly increase, linearly decrease, increase in a stepped, progressive or other manner or decrease in a stepped, progressive or other manner the second amplitude, height or depth by $x_2$ Volts over a time period $t_2$.

Preferably, $x_2$ is selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

Preferably, $t_2$ is selected from the group consisting of: (i) <1 ms; (ii) 1-10 ms; (iii) 10-20 ms; (iv) 20-30 ms; (v) 30-40 ms; (vi) 40-50 ms; (vii) 50-60 ms; (viii) 60-70 ms; (ix) 70-80 ms; (x)80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 ms; (xxi) 1-2 s; (xxii) 2-3 s; (xxiii) 3-4 s; (xxiv) 4-5 s; and (xxv) >5 s.

According to an embodiment the apparatus may further comprise a device arranged and adapted to vary, progressively increase, progressively decrease, progressively vary, scan, linearly increase, linearly decrease, increase in a stepped, progressive or other manner or decrease in a stepped, progressive or other manner the velocity or rate at which the one or more transient DC voltages or potentials or the one or more transient DC voltage or potential waveforms are applied to or translated along the first electrodes and/or the second electrodes by $x_3$ m/s over a time period $t_3$.

Preferably, $x_3$ is selected from the group consisting of: (i) <1; (ii) 1-2; (iii) 2-3; (iv) 3-4; (v) 4-5; (vi) 5-6; (vii) 6-7; (viii) 7-8; (ix) 8-9; (x) 9-10; (xi) 10-11; (xii) 11-12; (xiii) 12-13; (xiv) 13-14; (xv) 14-15; (xvi) 15-16; (xvii) 16-17; (xviii) 17-18; (xix) 18-19; (xx) 19-20; (xxi) 20-30; (xxii) 30-40; (xxiii) 40-50; (xxiv) 50-60; (xxv) 60-70; (xxvi) 70-80; (xxvii) 80-90; (xxviii) 90-100; (xxix) 100-150; (xxx) 150-200; (xxxi) 200-250; (xxxii) 250-300; (xxxiii) 300-350; (xxxiv) 350-400; (xxxv) 400-450; (xxxvi) 450-500; (xxxvii) 500-600; (xxxviii) 600-700; (xxxix) 700-800; (xl) 800-900; (xli) 900-1000; (xlii) 1000-2000; (xliii) 2000-3000; (xliv) 3000-4000; (xlv) 4000-5000; (xlvi) 5000-6000; (xlvii) 6000-7000; (xlviii) 7000-8000; (xlix) 8000-9000; (l) 9000-10000; and (li) >10000.

Preferably, $t_3$ is selected from the group consisting of: (i) <1 ms; (ii) 1-10 ms; (iii) 10-20 ms; (iv) 20-30 ms; (v) 30-40 ms; (vi) 40-50 ms; (vii) 50-60 ms; (viii) 60-70 ms; (ix) 70-80 ms; (x)80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 ms; (xxi) 1-2 s; (xxii) 2-3 s; (xxiii) 3-4 s; (xxiv) 4-5 s; and (xxv) >5 s.

The apparatus preferably further comprises a device arranged and adapted either:

(i) to generate a linear axial DC electric field along at least 1%, 5%, 10%, 20%, 30%, 40%, 50%, 60%, 70%, 80%, 90%, 95% or 100% of the axial length of the ion mobility spectrometer and/or the ion fragmentation or reaction device; or (ii) to generate a non-linear or stepped axial DC electric field along at least 1%, 5%, 10%, 20%, 30%, 40%, 50%, 60%, 70%, 80%, 90%, 95% or 100% of the axial length of the ion mobility spectrometer and/or the ion fragmentation or reaction device.

According to an embodiment the residence, transit or reaction time of at least 1%, 5%, 10%, 20%, 30%, 40%, 50%, 60%, 70%, 80%, 90%, 95% or 100% of ions passing through the ion mobility spectrometer and/or the ion fragmentation or reaction device is preferably selected from the group consisting of: (i) <1 ms; (ii) 1-5 ms; (iii) 5-10 ms; (iv) 10-15 ms; (v) 15-20 ms; (vi) 20-25 ms; (vii) 25-30 ms; (viii) 30-35 ms; (ix) 35-40 ms; (x) 40-45 ms; (xi) 45-50 ms; (xii) 50-55 ms; (xiii) 55-60 ms; (xiv) 60-65 ms; (xv) 65-70 ms; (xvi) 70-75 ms; (xvii) 75-80 ms; (xviii) 80-85 ms; (xix) 85-90 ms; (xx) 90-95 ms; (xxi) 95-100 ms; (xxii) 100-105 ms; 105-110 ms; (xxiv) 110-115 ms; (xxv) 115-120 ms; (xxvi) 120-125 ms; (xxvii) 125-130 ms; (xxviii) 130-135 ms; (xxix) 135-140 ms; (xxx) 140-145 ms; (xxxi) 145-150 ms; (xxxii) 150-155 ms; (xxxiii) 155-160 ms; (xxxiv) 160-165 ms; (xxxv) 165-170 ms; (xxxvi) 170-175 ms; (xxxvii) 175-180 ms; (xxxviii) 180-185 ms; (xxxix) 185-190 ms; (xl) 190-195 ms; (xli) 195-200 ms; and (xlii) >200 ms.

The ion mobility spectrometer and/or the ion fragmentation or reaction device preferably has a cycle time selected from the group consisting of: (i) <1 ms; (ii) 1-10 ms; (iii) 10-20 ms; (iv) 20-30 ms; (v) 30-40 ms; (vi) 40-50 ms; (vii) 50-60 ms; (viii) 60-70 ms; (ix) 70-80 ms; (x) 80-90 ms; (xi) 90-100 ms; (xii) 100-200 ms; (xiii) 200-300 ms; (xiv) 300-400 ms; (xv) 400-500 ms; (xvi) 500-600 ms; (xvii) 600-700 ms; (xviii) 700-800 ms; (xix) 800-900 ms; (xx) 900-1000 ms; (xxi) 1-2 s; (xxii) 2-3 s; (xxiii) 3-4 s; (xxiv) 4-5 s; and (xxv) >5 s.

According to another aspect of the present invention there is provided an ion detector for an ion mobility spectrometer, wherein the ion detector comprises a Gas Electron Multiplier ion detector.

According to another aspect of the present invention there is provided an ion detector for an ion fragmentation or reaction device, wherein the ion detector comprises a Gas Electron Multiplier ion detector.

According to another aspect of the present invention there is provided an ion detector for a mass analyser, wherein the ion detector comprises a Gas Electron Multiplier ion detector.

The ion detector preferably comprises:

at least a first foil layer, a first substrate or a first gas electron multiplier stage; and one or more electrodes, counter electrodes or cathodes arranged adjacent and/or facing the first foil layer, the first substrate or the first gas electron multiplier stage.

According to another aspect of the present invention there is provided a method of detecting ions comprising:

passing ions through an ion mobility spectrometer; and detecting at least some of the ions which emerge from the ion mobility spectrometer using a Gas Electron Multiplier ion detector.

According to another aspect of the present invention there is provided a method of detecting ions comprising:

passing ions through an ion fragmentation or reaction device; and detecting at least some of the ions which emerge from the ion fragmentation or reaction device using a Gas Electron Multiplier ion detector.

According to another aspect of the present invention there is provided a method of detecting ions comprising:

mass analysing ions in a mass analyser; and detecting at least some of the ions in the mass analyser using a Gas Electron Multiplier ion detector.

The method preferably further comprises:

providing an ion detector comprising at least a first foil layer, a first substrate or a first gas electron multiplier stage and one or more electrodes, counter electrodes or cathodes adjacent and/or facing the first foil layer, the first substrate or the first gas electron multiplier stage.

According to the preferred embodiment there is provided an apparatus comprising a modified gas avalanche electron multiplier ion detector. The ion detector preferably comprises a Gas Electron Multiplier detector which is preferably arranged and adapted to detect low energy ions.

The Gas Electron Multiplier ion detector according to a preferred embodiment is preferably arranged and adapted so as to detect both positively charged and negatively charged low energy ions. A Gas Electron Multiplier ion detector according to a preferred embodiment of the present invention preferably incorporates or includes an electrode or cathode which is preferably positioned in close proximity and facing the entrance to the Gas Electron Multiplier detector. The electrode or cathode is preferably arranged to be at a negative potential voltage with respect to the entrance to the Gas Electron Multiplier detector.

In operation, low energy positively charged analyte ions are preferably received in a drift region and are preferably accelerated away from the entrance to the Gas Electron Multiplier detector and are preferably accelerated towards the counter electrode or cathode. Positively charged ions preferably impact the surface of the counter electrode or cathode and preferably yield negatively charged secondary ions and/or secondary electrons and/or secondary cations. The secondary ions and/or secondary electrodes are preferably accelerated towards the entrance of the Gas Electron Multiplier device. The secondary negatively charged ions and/or secondary electrons preferably enter the Gas Electron Multiplier device whereupon the secondary electrons are amplified and are subsequently or ultimately detected by a readout electrode. Low energy negatively charged analyte ions which are received in the drift region adjacent the entrance to the Gas Electron Multiplier device may be accelerated directly towards the entrance of the Gas Electron Multiplier device. The negatively charged ions preferably cause an avalanche of electrons to be generated and hence the presence of the ions is effectively amplified and detected.

According to an embodiment the surface of the counter electrode or cathode which is preferably arranged in the drift region adjacent the entrance to the Gas Electron Multiplier device may be coated with a material which enhances the yield of secondary negatively charged ions. Additionally or alternatively, the surface of the counter electrode or cathode may be coated with a material which enhances the yield of secondary electrons.

According to a preferred embodiment the ion detector is preferably coupled with analytical instrumentation for the analysis and detection of analyte ions. The ion detector may, for example, be coupled with or to an ion mobility separator and/or a mass spectrometer. The ion mobility separator and/or mass spectrometer and/or ion detector may be maintained and operated at a pressure close to atmospheric pressure. Embodiments are also contemplated wherein the ion detector according to the preferred embodiment may be operated at a pressure above atmospheric pressure.

According to an alternative embodiment, the ion mobility separator and/or mass spectrometer and/or ion detector may be maintained and operated at sub-atmospheric pressures or at a partial vacuum. According to the preferred embodiment the ion detector may be maintained and operated at a pressure greater than 0.01 mbar, and more preferably at a pressure greater than 0.1 mbar.

Various embodiments of the present invention together with other arrangements given for illustrative purposes only, will now be described, by way of example only, and with reference to the accompanying drawings in which.

Figure 1:
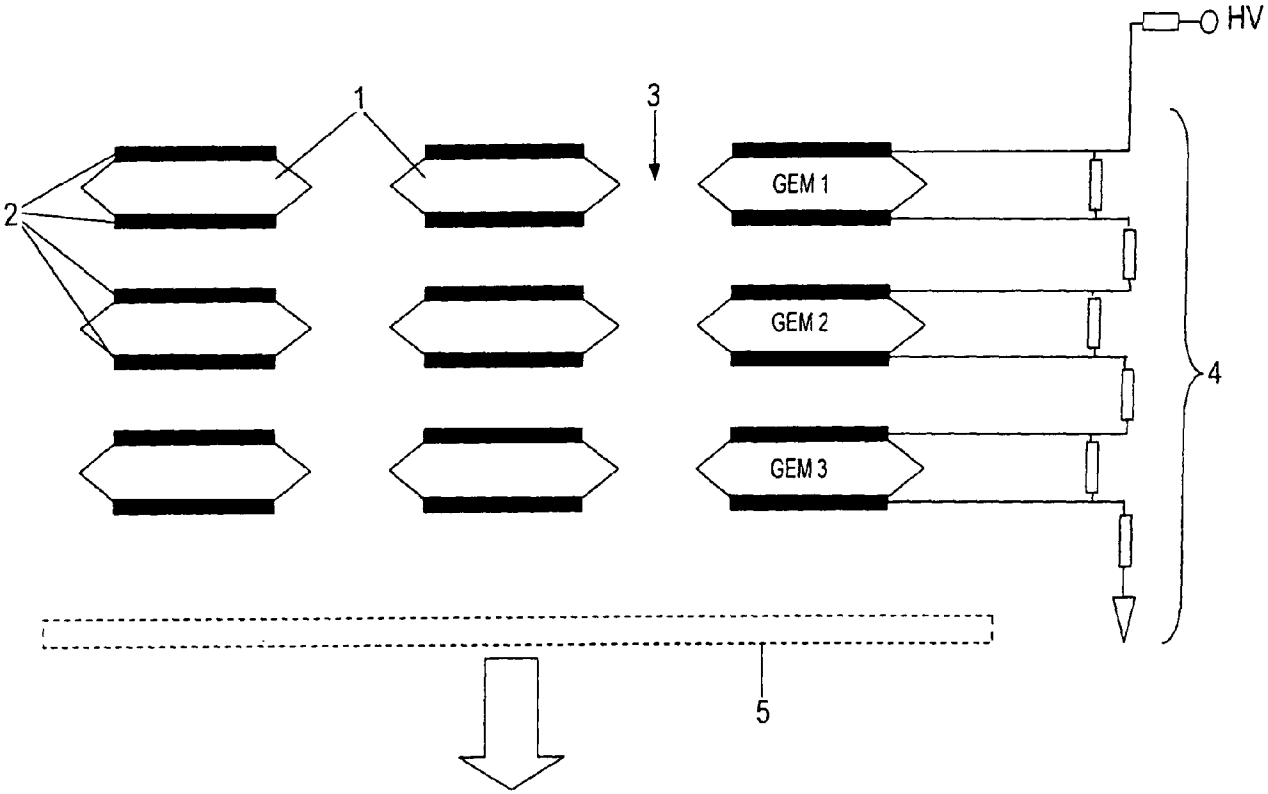
FIG. 1 PRIOR ART
FIG. 1 shows a known triple Gaseous Electron Multiplier radiation detector.

A known triple Gas Electron Multiplier detector which is designed to detect high energy radiation will now be described with reference to FIG. 1 for illustrative purposes only. The radiation detector comprises three thin insulating polymer sheets 1 (GEM1,GEM2,GEM3) each typically 50 μm thick. The polymer sheets are coated top and bottom with a thin layer 2 of copper. Small holes 3 are etched through the polymer sheets 1 and the holes 3 are typically 75 μm diameter on a 140 μm pitch.

Voltages are applied to the copper layers 2 using a resistor network 4 which is designed to produce an extremely high field within the holes 3 and a lower drift field in the regions in between the three sheets or foils (GEM1,GEM2,GEM3) and in an induction region between the third (final) sheet or foil (GEM3) and a readout electrode 5.

The high field within the holes 3 penetrates a short distance into the open space or drift region in front of the first stage (GEM1) of the radiation detector. The high field which leaks into the space in front of the radiation detector will act to accelerate any negatively charged particles towards the entrance of the first stage (GEM1) of the radiation detector. However, at the same time the high field which leaks into the drift region in front of the first stage (GEM1) of the detector will have the effect of accelerating any positively charged particles away from the entrance to the detector.

Figure 2A:
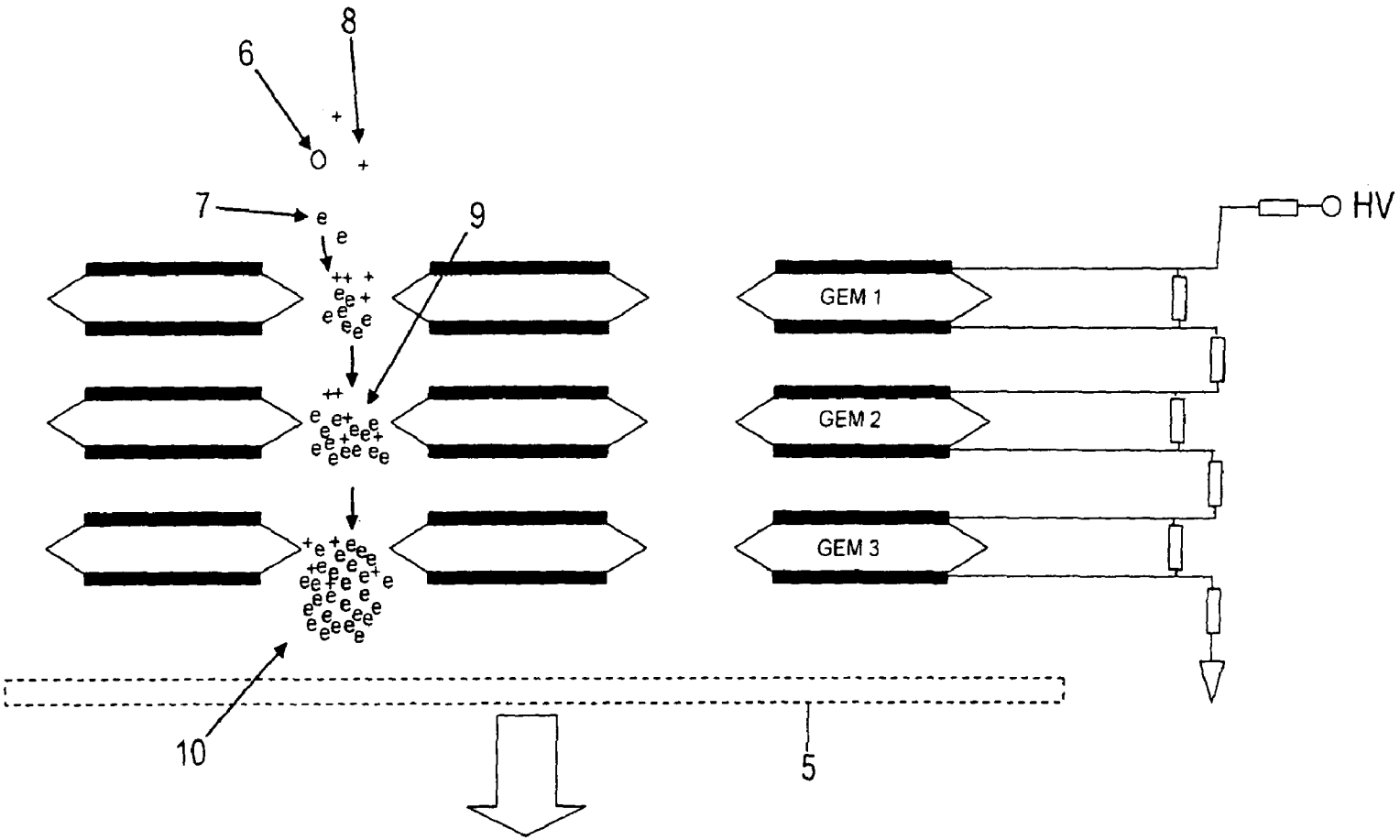
FIG. 2A PRIOR ART
FIG. 2A shows a schematic of the principle of operation of a known Gaseous Electron Multiplier radiation detector which is used to detect high energy particles and FIG. 2B shows a schematic of the principle of operation of the known Gaseous Electron Multiplier radiation detector when detecting photons.
Figure 2B:
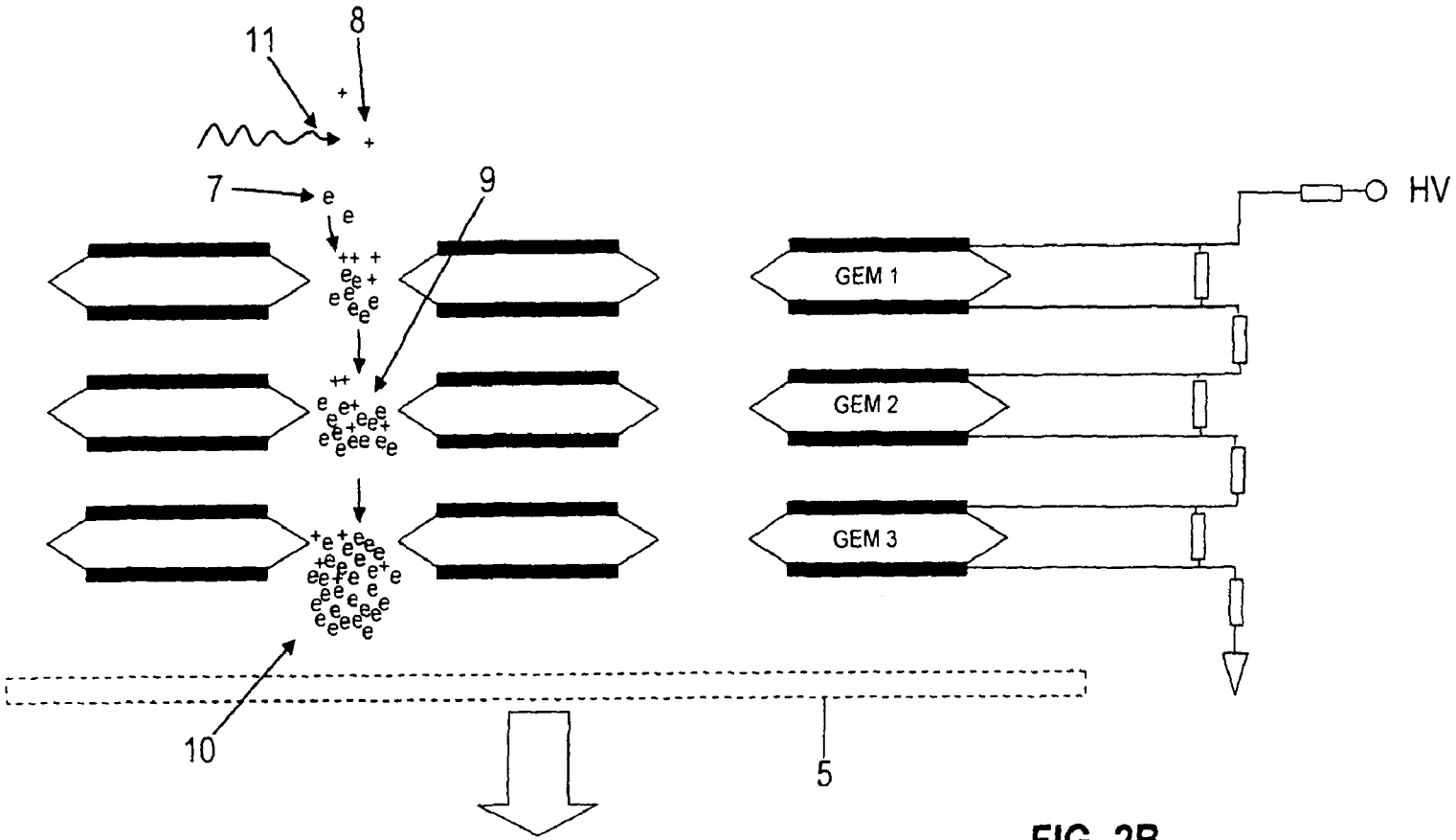
FIG. 2B PRIOR ART

FIGS. 2A and 2B show the principle of operation of the known Gas Electron Multiplier radiation detector which is used to detect high energy particles (e.g. particles in the MeV energy range) and photons (e.g. x-rays and gamma rays etc). FIG. 2A shows an incident high energy particle 6 passing through the space in front of the entrance to the first stage (GEM1) of the radiation detector. The high energy particle 6 ionises the ambient gas atoms or molecules and produces both electrons 7 and positive ions 8. The electric field leaking into the open space in front of the entrance to the first stage (GEM1) of the radiation detector will cause the positive ions 8 to move away from the entrance to the detector. At the same time, the electric field will cause the electrons 7 to move towards the holes in the first foil (GEM1).

The electrons 7 enter the holes 3 in the first foil (GEM1) and are then accelerated by the high electric field within the holes 3 in the first foil layer (GEM1) thereby initiating a short lived Townsend discharge. This produces more electrons as well as positive ions within the holes in the first foil layer (GEM1). Photons may also be produced dependent upon the ambient gas.

The positive ions which are produced within the holes in the first foil layer (GEM1) will be attracted to the entrance electrode forming the first foil (GEM1) whilst the electrons will proceed to enter holes 9 in the second foil (GEM2). The electrons which enter the holes 9 in the second foil (GEM2) will initiate a further Townsend discharge which produces more electrons and positive ions within the holes 9 in the second foil layer (GEM2). The process repeats itself as electrons created within the holes 9 in the second foil (GEM2) will then subsequently proceed to enter holes in the third foil (GEM3) where again a Townsend discharge will be initiated producing yet further electrons and positive ions. The electrons 10 in the holes in the third foil (GEM3) are then accelerated through an induction region and are collected by a readout electrode 5 which results in a current pulse which may be as short as 10 ns in duration. The induction region is the region between the third foil layer (GEM3) and the readout electrode 5. According to this arrangement the electron gain is typically of the order $10^4$-$10^6$.

FIG. 2B illustrates the conventional arrangement in the case of ionising radiation. An incident photon 11 passing through the drift region of the space in front of the entrance to the first stage (GEM1) of the detector may ionise the ambient gas atoms or molecules thereby producing electrons 7 and positive ions 8. The process is then the same as described above with reference to the arrangement shown in FIG. 2A. Alternately, the photon may be incident onto a photocathode material such as a surface layer of CsI deposited on the open or upper surface of the entrance electrode to the first stage (GEM1) of the detector. Photoelectrons emitted from the photocathode are attracted to the holes 3 in the first foil (GEM1) and the avalanche process is then the same as described above.

Figure 3:
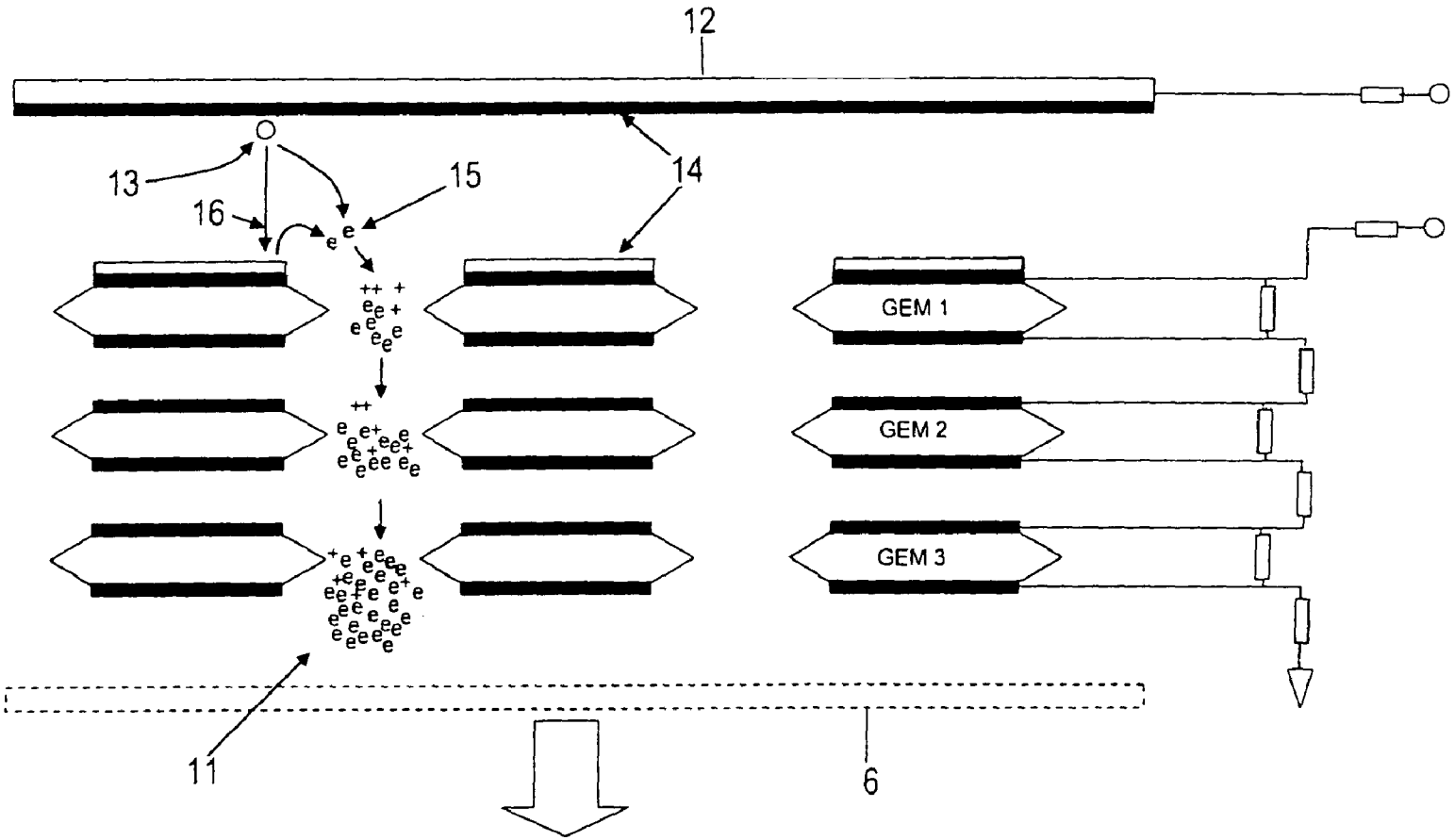
FIG. 3 shows a schematic of an embodiment of the present invention wherein a gas avalanche electron multiplier is configured to detect low energy positive ions using secondary electron emission as an avalanche electron source.

FIG. 3 shows a Gas Electron Multiplier ion detector according to an embodiment of the present invention. According to a preferred embodiment a gas avalanche electron multiplier ion detector is provided which is arranged and adapted to detect low energy positive ions. A counter electrode or cathode 12 is preferably positioned in close proximity to and facing the entrance to the first stage (GEM1) of the ion detector. Analyte ions are preferably arranged to pass between the counter electrode or cathode 12 and the entrance to the first stage (GEM1) of the ion detector by passing through a drift region located between the counter electrode or cathode 12 and the upper surface of the first stage (GEM1) of the ion detector.

According to an embodiment ions may be arranged to enter the drift region from the side between the two surfaces i.e. between the counter electrode or cathode 12 and the upper surface of the first foil layer (GEM1). Alternatively, the counter electrode 12 may be made from a grid or mesh and may contain holes through which analyte ions may pass in use. FIG. 3 shows an incident low energy positive analyte ion 13 being attracted to the counter electrode or cathode 12 by the application of a negative potential to the counter electrode or cathode which may be several kV. As the analyte ion 13 moves towards the counter electrode or cathode 12 it may preferably collide with gas molecules in the detector or drift region. As a result, the analyte ion 13 may be unable to attain the impact velocity that it would otherwise have in the absence of the gas.

The surface of the counter electrode or cathode 12 may according to one embodiment comprise a surface coating 14, which is preferably designed to enhance the yield of secondary negative ions and/or secondary electrons due to low energy ion bombardment. The impact of the incident ion 13 upon the surface of the counter electrode or cathode 12 will preferably cause secondary negative ions and electrons 15 to be emitted from the surface coating or layer 14.

The number of secondary electrons emitted from a surface undergoing ion bombardment may be described by a Poisson distribution.

From a knowledge of the average secondary electron yield γ the probability P(n) of emitting n secondary electrons is:

$$P(n) = \frac{y^n}{n!} e^{-y} \tag{1}$$

Hence, the probability P(0) of generating zero secondary electrons is:

$$P(O)=e^{-y} \tag{2}$$

Hence, the probability of emitting one or more electrons may be calculated as follows:

$$P(\geqq 1)=1-P(O)=1-e^{-y} \tag{3}$$

The actual yield will be dependent upon many factors including the work function of the bombarded material, the mass of the incident molecular ion, the ion elemental composition, the ion impact angle and the ion impact velocity.

Secondary electron emission resulting from high energy (or velocity) molecular ion bombardment of materials has been studied and it is known that secondary electron yield decreases as the velocity of the incident molecular ions decreases. It has therefore previously been believed that an ion detection velocity threshold exists around 10 to 18 mm/μs below which point no secondary electrons will be emitted. However, recent measurements show that this is not actually the case and that some secondary electron emission occurs for incident ion velocities as slow as 4 mm/μs. For example, Brunelle (Rapid Commun. Mass Spectrom. 1997, 353) has shown that the detection probability for a 66 kDa ion at an impact velocity of 6 mm/μs is approximately 0.2.

Brunelle and Westmacott (Nucl. Instrum. Methods B 1996, 108: 282.) have published data in the sub 20 mm/μs velocity range. Westmacott gives data from insulin (5733.5 Da), trypsin (~23540 Da), human tranferrin (~79500 Da) and β-galactosidase (~113600 Da) bombardment of stainless steel (SS) and CsI surfaces. Brunelle shows data from Luteinizing Hormone Releasing hormone ("LHRH") having a mass of 1182.3 Da, bovine insulin (5733.5 Da), bovine trypsin (23296 Da) together with bovine serum albumin (66430 Da) bombardment of CsI.

Figure 4:
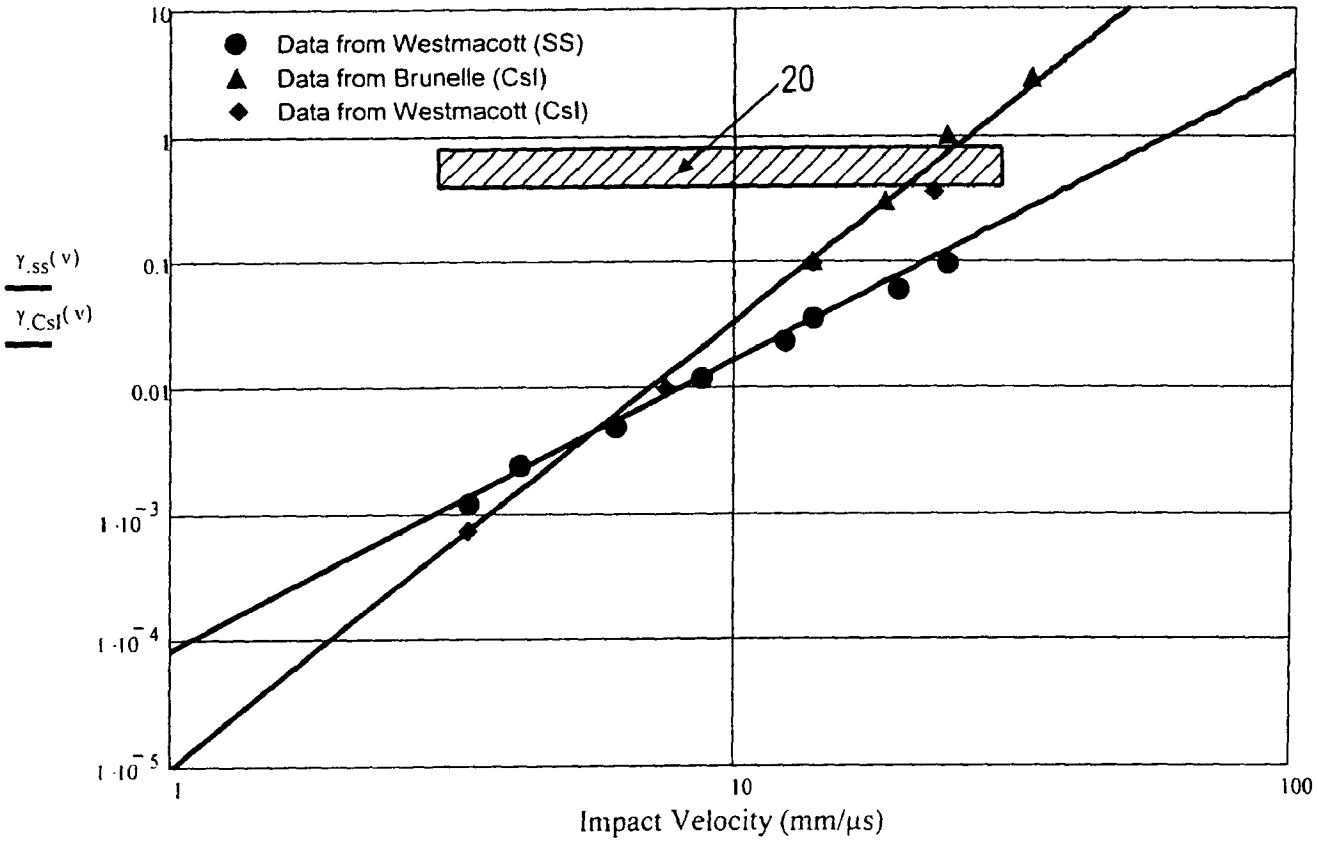
FIG. 4 shows the secondary electron yield taken from literature for an incident ion of mass 1182.3 Da on a CsI substrate and on a stainless steel surface.

Westmacott has shown that when the so called reduced secondary yield (γ divided by the projectile mass), is plotted against projectile energy per unit mass (at least between approx. 5 kDa and 120 kDa) then all of the data points lie on the same curve for a given target material. The data published by Brunelle shows data from LHRH at 1182.3 Da which also allows the secondary yield as a function of the projectile velocity to be determined. This data is shown in FIG. 4 along with the data published by Westmacott scaled to give the secondary electron yield expected by LHRH (1182.3 Da) as a function of projectile velocity (mm/μs). It is noted that there is good agreement between the Westmacott and Brunelle data for CsI targets. For example, a LHRH ion incident onto a surface with a velocity of 7 to 8 mm/μs would have a γ of 0.01.

As has been previously stated Faraday cup detection systems as used, for example, in ion mobility spectrometers require a minimum of $10^3$ ions and more typically $10^4$ or more ions before a signal may be detected. According to the preferred embodiment, for a secondary electron yield of 0.01 then approximately only 100 ions are required for a signal to be detected. This is approximately one to two orders of magnitude less than that of a conventional Faraday cup detector and hence the preferred ion detector represents a significant improvement in the art.

With reference back to FIG. 3, emitted secondary electrons 15 are accelerated into the holes in the upper electrode (GEM1) which has the effect of initiating an avalanche of electrons in a manner as described above. Some secondary electrons 16 may, however, strike the surface of the entrance electrode of the first stage (GEM1) of the detector thereby causing yet further electrons to be emitted. These further electrons are also preferably accelerated into the holes in the first electrode (GEM1) thereby initiating an avalanche. The exposed surface of the electrode may be coated with a material to enhance the secondary electron yield.

Figure 5:
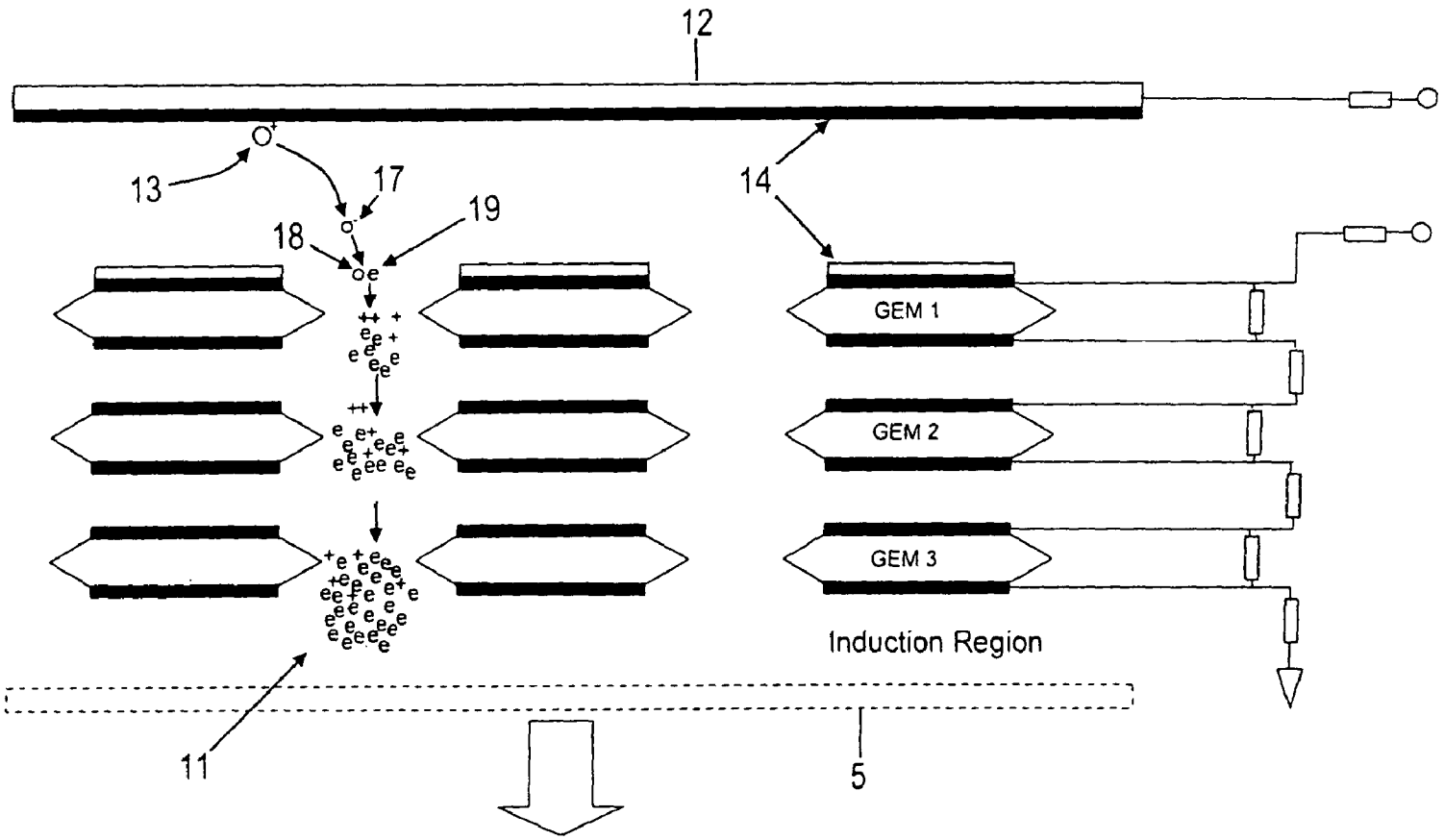
FIG. 5 shows a schematic of an embodiment comprising a gas avalanche electron multiplier which is configured to detect positive ions using secondary negative ion emission as an avalanche electron source.

In addition, positive analyte ions incident upon the surface of the counter electrode or cathode 12 may also emit secondary negatively charged ions 17. Under certain circumstances this may be a more efficient detection mechanism and this embodiment now be described in more detail with reference to FIG. 5. As shown in FIG. 5, a low energy positive analyte ion 13 will be attracted to the counter electrode or cathode 12 by the application of a negative potential to the counter electrode or cathode 12. The impact of the incident positive ion 13 upon the counter electrode or cathode 12 may cause secondary negative ions 17 to be emitted.

The surface of the counter electrode or cathode 12 may comprise a coating 14 to enhance the yield of secondary negative ions due to low energy positive ion bombardment. The impact of the incident positive ion 13 preferably causes secondary negative ions 17 to be emitted. The secondary negative ions 17 preferably drift towards the entrance electrode of the first foil (GEM1). Upon entering a hole in the entrance electrode of the first foil (GEM1) the secondary negative ions 17 are preferably accelerated and this preferably results in high energy collisions with gas molecules. These collisions preferably yield electrons and positive ions with the electrons 19 initiating an avalanche sequence as described previously. It is believed that negatively charged ions may be stripped of their extra electron by collisional ionisation due to the extremely high field in this region producing a neutral molecule 18 and a free electron 19. The free electrons 19 preferably initiate an avalanche sequence as described previously.

Westmacott has presented data for the secondary negative ion yield from CsI and stainless steel from relatively high mass incident positive ions such as insulin, trypsin, human tranferrin (singly and doubly charged) and β-galactosidase. It has been reported that the efficiency for secondary negative ion emission was between 0.4 and 0.8 irrespective of the mass and velocity of the incident ion. In these studies the incident positive ions had velocities in the range from 3 to 28 mm/μs. This region of operation is indicated by the shaded area 20 in FIG. 4.

This mode of operation provides one to two orders of magnitude higher yield than that for secondary electron emission. According to the preferred embodiment, for a secondary negative ion yield of approximately 0.4 to 0.8 then only approximately 1 to 3 ions may be required for a signal to be detected. This is approximately two and a half to four orders of magnitude less than that for a Faraday cup detector. In practice, both secondary electron and secondary negative ion emission mechanisms are likely to be operating simultaneously.

Examples of coatings that may be used to enhance the secondary electron yield and/or to enhance the secondary negative ion yield from the various surfaces as described above include, but are not limited to, CsI, CsTe, αCH:N, Cu, Al, MgO, $MgF_2$ and W.

Figure 6:
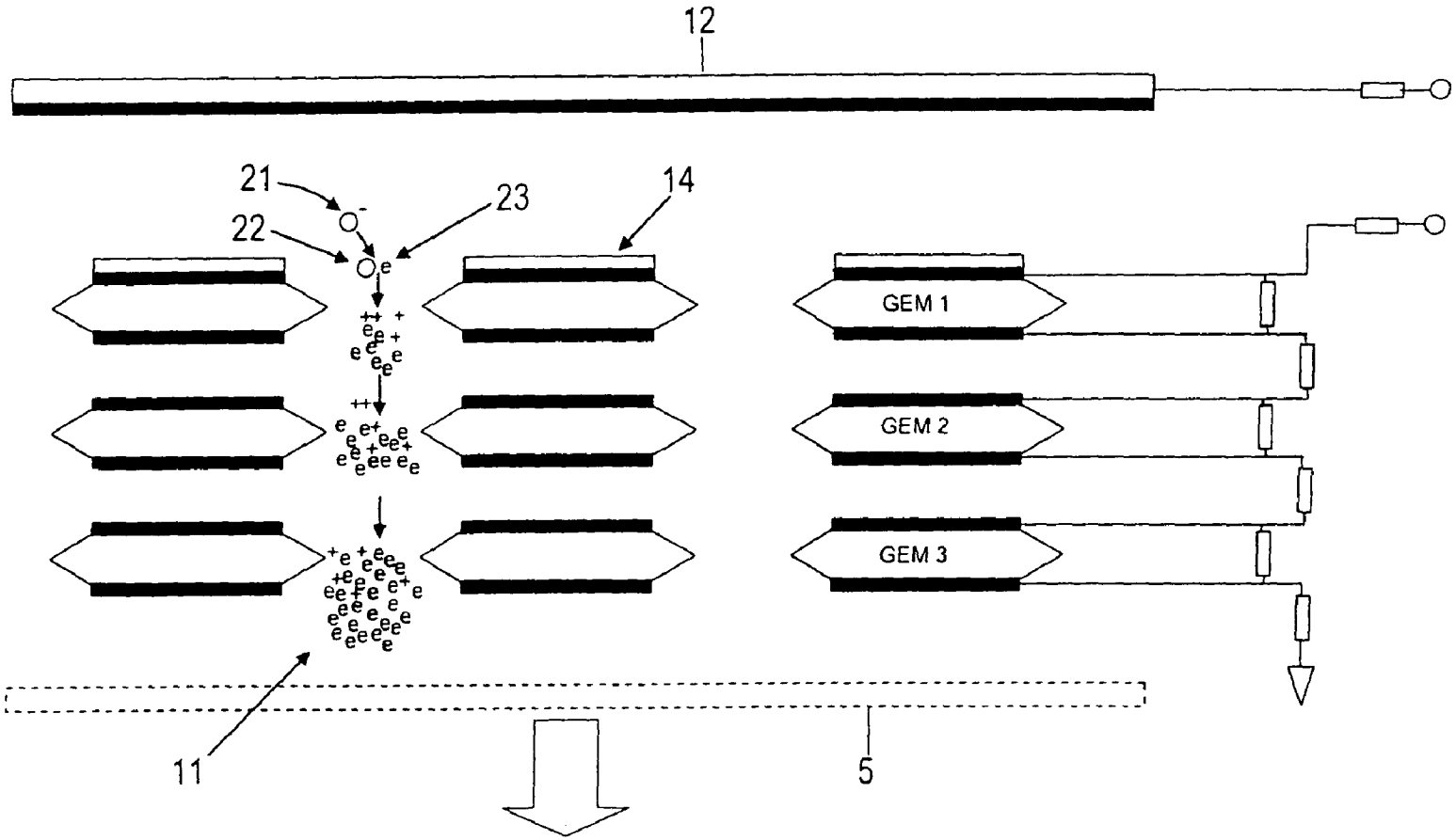
FIG. 6 shows schematic of an embodiment comprising a gas avalanche electron multiplier which is configured to detect low energy negative ions.

FIG. 6 shows an embodiment of a gas avalanche electron multiplier detector according to an embodiment of the present invention which is arranged and adapted to detect low energy negative ions. A negative potential may preferably be applied to the counter electrode or cathode 12. This may be the same potential as that applied previously for low energy positive ion detection. The incident negative ion 21 is preferably repelled by the counter electrode or cathode 12 and is accelerated directly towards the entrance of the first stage (GEM1) of the detector. Upon entering a hole in the entrance electrode of the first stage (GEM1) of the detector, the secondary negative ions 21 are preferably accelerated and this preferably results in high energy collisions with gas molecules. These collisions preferably yield electrons and positive ions. It is believed that negatively charged ions can be stripped of their extra electron by collisional ionisation due to the extremely high field in this region producing a neutral molecule 22 and a free electron 23. The electrons 23 then preferably initiate an avalanche sequence as described previously.

There is also the possibility that the incident negative ion 21 may impact upon the electrode entrance surface of the first foil (GEM1). In this case a secondary electron or negative ion may result and this would be directed into one of the holes in the first foil electrode (GEM1) producing an avalanche of electrons.

It is to be noted that in this configuration the detector will respond to both positive and negative ions without changing any voltages.

According to a preferred embodiment three foil electrodes may be provided (GEM1,GEM2,GEM3) which are each 50 μm thick. The foil electrodes are preferably spaced 1 mm apart and the distance between the first foil electrode (GEM1) and the counter electrode or cathode 12 is preferably arranged to be 3 mm. For illustrative purposes only, the front or upper face of the first foil electrode (GEM1) may be arranged to be at ground potential and a potential difference or voltage difference of 100 V may be arranged to be maintained across each of the foil electrodes (GEM1,GEM2,GEM3) thereby producing an electric field of 200 kV/cm within the holes. A potential difference or voltage difference of 30 V may be maintained between adjacent foil electrodes (GEM1,GEM2, GEM3) and also between the last foil electrode (GEM3) and the readout anode 5. As a result, an electric field of 3 kV/cm is preferably maintained within these regions. The potential difference or voltage difference between the first foil electrode (GEM1) and the counter electrode or cathode 12 may be arranged to be −1000 V so that the electric field in the initial drift region may be 3 kV/cm.

According to an embodiment of the present invention the communication between the gas avalanche electron multiplier elements may be via photo-electron emission. According to an embodiment, a first charge blocking mesh electrode may be provided between the first foil electrode (GEM1) and the second foil electrode (GEM2). Anode and/or cathode strips are preferably provided on the lower surface of the first foil electrode (GEM1). Avalanche electrons formed within the holes in the first foil electrode (GEM1) are preferably directed or deflected onto the anode strips provided on the lower surface of the first foil electrode (GEM1). As a result, a second avalanche preferably occurs at the anode strips. Avalanche generated photons preferably pass through the first charge blocking mesh grid and impinge upon a photocathode surface which is preferably provided on the upper surface of the second foil electrode (GEM2). The photocathode surface preferably comprises CsI. As a result, photoelectrons are preferably induced or released from the photocathode deposited upon the upper surface of the second foil electrode (GEM2). The photoelectrons are preferably accelerated into the holes in the second foil electrode (GEM2) and preferably create further avalanche electrons.

The first charge blocking mesh electrode may be polarised or grounded such that the electric fields either side of the first mesh electrode are reversed. Any positive avalanche ions created within the holes in the first foil electrode (GEM1) will preferably be directed towards the first charge blocking mesh electrode. Similarly, any positive avalanche ions created within the holes in the second foil electrode (GEM2) will also be directed back towards the first charge blocking mesh electrode.

According to this embodiment ion backflow is effectively reduced or eliminated. Furthermore, by employing an appropriately biased intermediate grid or charge blocking electrode the transport both of electrons and back-drifting ions between the first and second foil electrodes (GEM1,GEM2) may effectively be blocked or prevented.

Other embodiments are contemplated wherein additionally or alternatively, a second charge blocking mesh or intermediate grid may be provided between the second foil electrode (GEM2) and the third foil electrode (GEM3). According to this embodiment, anode and/or cathode strips are preferably provided on the lower surface of the second foil electrode (GEM2). Avalanche electrons formed within the holes in the second foil electrode (GEM2) are preferably directed or deflected onto the anode strips provided on the lower surface of the second foil electrode (GEM2). As a result, a second avalanche preferably occurs at the anode strips. Avalanche generated photons preferably pass through the second charge blocking mesh grid and preferably impinge upon a photocathode surface which is preferably provided on the upper surface of the third foil electrode (GEM3). The photocathode surface preferably comprises CsI. As a result, photoelectrons are preferably induced or released from the photocathode deposited upon the upper surface of the third foil electrode (GEM3). The photoelectrons are preferably accelerated into the holes in the third foil electrode (GEM3) and preferably create further avalanche electrons.

The second charge blocking mesh electrode may be polarised or grounded such that the electric fields either side of the second mesh electrode are reversed. Any positive avalanche ions created within the holes in the second foil electrode (GEM2) will preferably be directed towards the second charge blocking mesh electrode. Similarly, any positive avalanche ions created within the holes in the third foil electrode (GEM3) will also be directed back towards the second charge blocking mesh electrode.

According to an embodiment which is given for illustrative purposes only, three foil electrodes may be provided (GEM1, GEM2,GEM3) which are each 50 μm thick and spaced 2 mm apart from each other. The distance between the first foil electrode (GEM1) and the counter electrode or cathode 12 is preferably arranged to be 3 mm. Two charge blocking mesh electrodes may be provided which are preferably located at the midpoint between the three foil electrodes (GEM1, GEM2,GEM3). The front or upper face of the foil electrodes (GEM1,GEM2,GEM3) may be connected to ground potential. The voltage difference or potential difference across the holes in the foil electrodes between the upper electrode on a foil electrode and the lower electrode cathode strip may be arranged to be 100 V. The voltage between the anode strips and the cathode strips on the lower electrode of the foil electrodes (GEM1,GEM2,GEM3) may be arranged to be 20 V (i.e. 120 V w.r.t. ground). The charge blocking mesh electrodes are preferably connected to ground potential and the potential between the last foil electrode (GEM3) and the readout anode 5 may be arranged to be 30V ('i.e. 150 V w.r.t. ground). The voltage difference between the first foil electrode and the counter electrode or cathode 12 may be arranged to be −1000 V.

A further embodiment is contemplated wherein the readout electrode 5 may be replaced by a photo-multiplier tube or by a CCD camera. The photo-multiplier tube or CCD preferably add further gain to the overall ion detector and thereby enables the previous Gas Electron Multiplier stages to be operated with lower gain. As a result, the Gas Electron Multiplier stages can be maintained at lower voltages. The use of a CCD camera detector also enables the ion detector to be used for recording images in applications where spatial information is of value.

According to another embodiment an additional Gas Electron Multiplier stage (GEM0) may be provided prior to the first Gas Electron Multiplier stage (GEM1) of the ion detector. A positive potential may be applied to the counter electrode or cathode 12 in order to repel positive analyte ions. The potential between the entrance and exit electrodes of the additional Gas Electron Multiplier stage (GEM0) may be arranged such that positive analyte ions are attracted to and accelerated within the holes of the entrance electrode of the additional Gas Electron Multiplier stage (GEM0). Upon entering a hole in the entrance electrode of the additional stage (GEM0) the positive analyte ions may be accelerated and collide with the ambient gas molecules. The collisions may be arranged such that the analyte ions become excited (e.g. into a metastable state) promoting electrons to higher energy states. As a result, photons may be emitted upon relaxation of the promoted electrons to ground states. The photons which are emitted as a result of the metastable ions relaxing to a ground state may then be arranged to be incident upon a photocathode material which is preferably deposited on the entrance electrode of the first Gas Electron Multiplier stage (GEM1) thereby releasing photoelectrons. The photoelectrons are then preferably arranged to be incident into the entrance holes of the first Gas Electron Multiplier stage (GEM1) initiating an avalanche sequence as described above.

Figure 7:
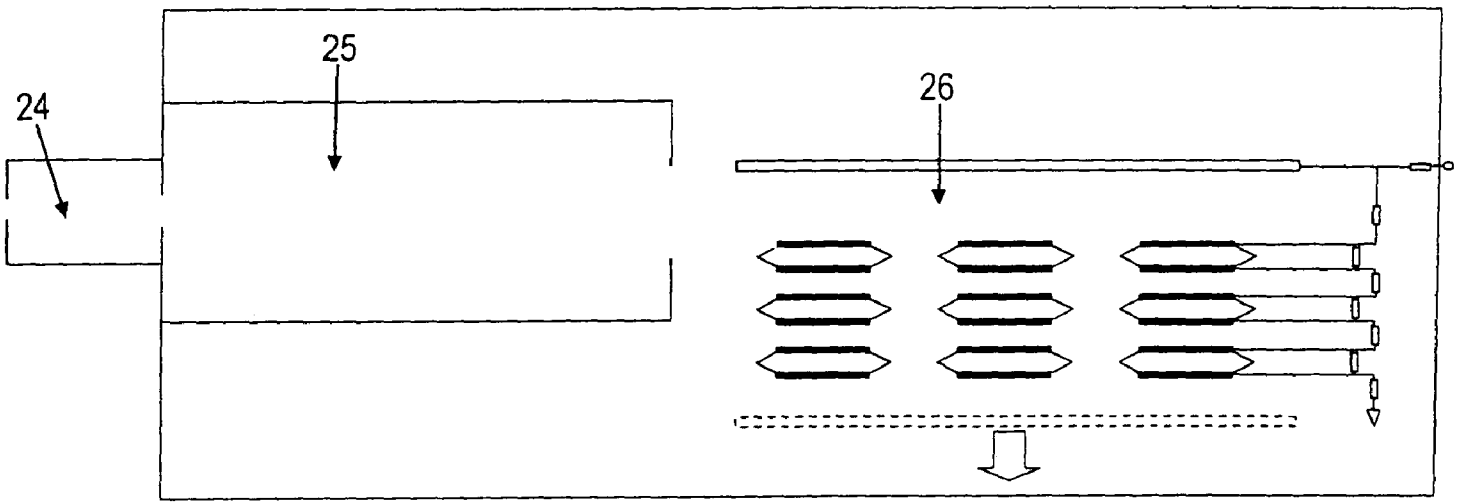
FIG. 7 shows an ion mobility spectrometer incorporating a Gas Electron Multiplier ion detector according to an embodiment of the present invention.

According to an embodiment as shown in FIG. 7 an apparatus may be provided comprising a source of ions and a means or device of sampling the ions 24. An ion mobility separator 25 may be arranged downstream of the ion source and the means or device 24 for sampling the ions. At least some of the ions are preferably separated according to their ion mobility or rate of change of ion mobility with electric field strength in the ion mobility separator 25. An ion detector 26 according to the preferred embodiment is preferably provided downstream of the ion mobility spectrometer 25. A particularly advantageous feature of this embodiment is that both the ion mobility spectrometer 25 and the ion detector 26 according to the preferred embodiment may be maintained at a relatively high pressure thereby avoiding the need for expensive and complicated high vacuum pumping systems. The overall apparatus may comprise a hand held and/or otherwise portable device. Alternatively, the ion mobility spectrometer including an ion detector 26 according to the preferred embodiment may comprise a static or essentially fixed device.

At the upstream end of the apparatus, the ion source 24 may comprise a pulsed ion source such as a Laser Desorption Ionisation (LDI) ion source, a Matrix Assisted Laser Desorption Ionisation ("MALDI") ion source or a Desorption Ionisation on Silicon ("DIOS") ion source.

Alternatively, a continuous ion source may be used in which case an ion gate for creating a pulse of ions may be provided. The ion gate is preferably arranged to pulse ions into the ion mobility spectrometer. According to another embodiment an ion trap for storing ions and periodically releasing ions may be provided. The ion trap may be arranged to periodically release ions in packets or pulses so that packets or pulses of ions subsequently enter into the ion mobility spectrometer.

Continuous ion sources which may be used include an Electron Impact ("EI") ion source, a Chemical Ionisation ("CI") ion source, an Electrospray Ionisation (ESI) ion source, an Atmospheric Pressure Chemical Ionisation ("APCI") ion source, an Atmospheric Pressure Photon Ionisation ("APPI") ion source, a Fast Atom Bombardment ("FAB") ion source, a Liquid Secondary Ion Mass Spectrometry ("LSIMS") ion source, a Field Ionisation ("FI") ion source or a Field Desorption ("FD") ion source. Other continuous or pseudo-continuous ion sources may also be used.

The ion mobility separator 25 preferably comprises a device that causes ions to become temporally separated based upon or according to their ion mobility. The ion mobility spectrometer may have a number of different forms.

According to an embodiment the ion mobility spectrometer or separator may be provided in chamber that is preferably maintained, in use, at a pressure at or above atmospheric pressure. According to another embodiment the ion mobility spectrometer or separator may be provided in a vacuum chamber that is preferably maintained, in use, at a pressure within the range 0.1-10 mbar. According to other embodiments, the vacuum chamber may be maintained at a pressure greater than 10 mbar up to a pressure at or near atmospheric pressure. According to less preferred embodiments, the vacuum chamber may be maintained at a pressure below 0.1 mbar.

In one embodiment, the ion mobility separator 25 may comprise an ion mobility separator comprising a drift tube having a number of guard rings distributed within the drift tube. The guard rings may be interconnected by equivalent valued resistors and connected to a DC voltage source. A linear DC voltage gradient may be generated along the length of the drift tube. The guard rings are not connected to an AC or RF voltage source.

According to another embodiment the ion mobility spectrometer or separator 25 may comprise a number of ring, annular or plate electrodes, or more generally electrodes having an aperture therein through which ions are transmitted. The ion mobility separator may comprise a plurality of electrodes arranged in a chamber at low pressure or under a partial vacuum. Alternate electrodes forming the ion mobility separator are preferably coupled to opposite phases of an AC or RF voltage supply. The AC or RF voltage supply preferably has a frequency within the range 0.1-10.0 MHz, preferably 0.3-3.0 MHz, further preferably 0.5-2.0 MHz.

The electrodes comprising the ion mobility spectrometer or separator are preferably interconnected via resistors to a DC voltage supply. The resistors interconnecting electrodes forming the ion mobility spectrometer or separator may be substantially equal in value in which case an axial DC voltage gradient is preferably obtained. The DC voltage gradient may be linear or stepped. The gradient may be applied so to propel ions towards the detector or towards the source. The applied AC or RF voltage is preferably superimposed upon the DC voltage and serves to confine ions radially within the ion mobility spectrometer or separator.

According to another preferred embodiment of the present invention the ion mobility spectrometer or separator 25 may comprise a travelling wave ion guide comprising a plurality of electrodes. Adjacent electrodes are preferably connected to the opposite phases of an AC or RF supply. Transient DC voltages are preferably applied to one or more electrodes to form one or more potential hills or barriers. Transient DC voltages are preferably progressively applied to a succession of electrodes such that the one or more potential hills or barriers move along the axis of the ion guide in the direction in which the ions are to be propelled or driven which may be towards the ion source or towards the ion detector 26.

The presence of gas within the ion mobility spectrometer preferably imposes a viscous drag on the movement of ions through the ion mobility spectrometer 25. The amplitude and average velocity of the one or more potential hills or barriers which is preferably applied in a transient manner to the electrodes forming the ion mobility spectrometer 25 is preferably set such that ions will, from time to time, slip over a potential hill or barrier. The lower the mobility of the ion the more likely the ion will slip over a potential hill or barrier. This in turn allows ions of different mobility to be transported at different velocities and thereby separated as the one or more transient DC voltages or potentials is applied to the electrodes forming the ion mobility spectrometer.

According to another embodiment the ion mobility spectrometer or separator 25 may comprise a device as described in WO2006/085110 which is incorporated herein by reference. The device or ion mobility spectrometer may preferably comprise an upper planar electrode, a lower planar electrode and a plurality of intermediate electrodes. An ion guiding region is preferably formed within the ion guide. An asymmetric voltage waveform is preferably applied to the upper electrode and a DC compensating voltage is preferably applied to the lower electrode.

According to another embodiment the ion mobility spectrometer or separator 25 may comprise a device as described in WO 2006/059123 which is incorporated herein by reference. The ion mobility spectrometer or device may preferably comprise one or more layers of intermediate planar, plate or mesh electrodes. A first array of electrodes is preferably provided on an upper surface and a second array of electrodes is preferably arranged on a lower surface. An ion guiding region is preferably formed within the ion guide. One or more transient DC voltage or potentials are preferably applied to the first and/or second array of electrodes in order to urge, propel, force or accelerate ions through and along the ion guide.

According to an embodiment the detector according to the preferred embodiment may be used with a differential ion mobility separator or with a Field Asymmetric Ion Mobility Spectrometer ("FAIMS") device.

According to another embodiment the ion mobility spectrometer or separator 25 may be of the form described in WO2004/109741 which is incorporated herein by reference. The ion mobility spectrometer is preferably arranged to extract ions by entraining ions in a laminar flow of a carrier gas. A barrier region is preferably provided and an electrical field is preferably applied across the laminar flow of the carrier gas. The magnitude and direction of the electrical field is preferably selected so as to prevent at least some of the ions entrained in the laminar flow from passing through the electrical field. The electrical field is preferably varied to allow ions having predetermined characteristics to pass through the electrical field.

The ion detector 26 according to the preferred embodiment preferably comprises a gas avalanche electron multiplication device that is preferably configured to detect both low energy positive and low energy negative ions.

Figure 8:
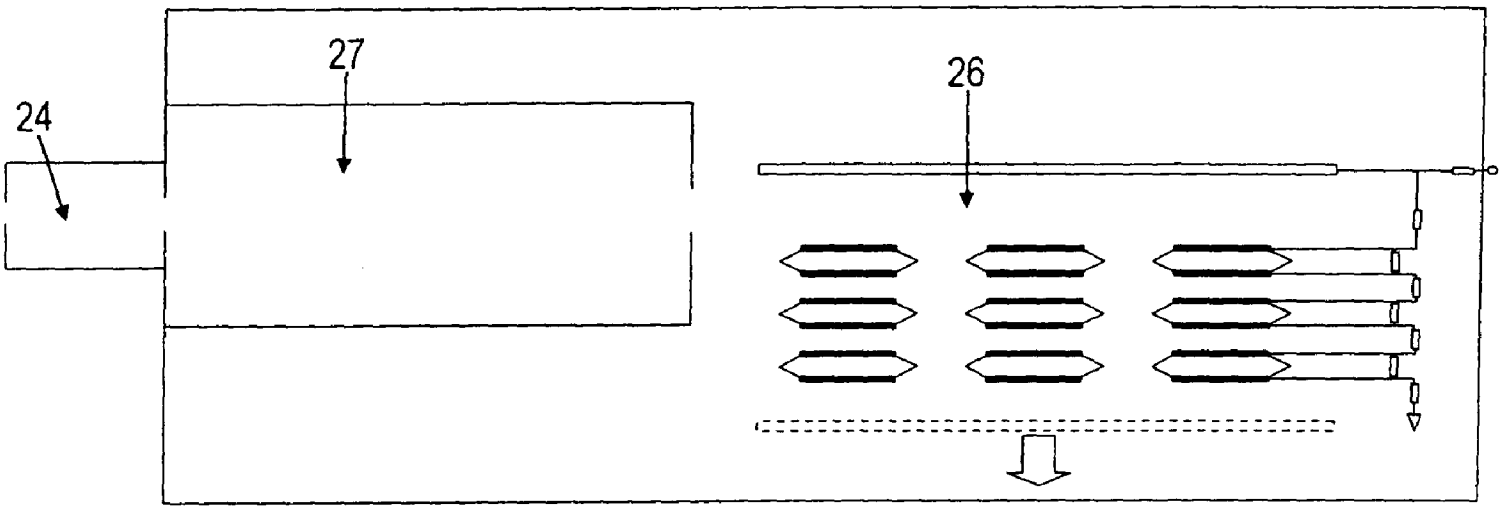
FIG. 8 shows a mass spectrometer incorporating a Gas Electron Multiplier ion detector according to an embodiment of the present invention.

According to another embodiment as shown in FIG. 8 a mass spectrometer is preferably provided which preferably comprises a source of ions and a means of or device for sampling the ions 24. The mass spectrometer preferably comprises a mass analyser 27 and an ion detector 26. The apparatus or mass spectrometer may comprise a hand held and/or portable device. Alternatively, the mass spectrometer may comprise a static or fixed device.

At the upstream end of the apparatus or mass spectrometer, an ion source 24 may be provided. The ion source preferably comprise a pulsed ion source such as a Laser Desorption Ionisation ("LDI") ion source, a Matrix Assisted Laser Desorption Ionisation ("MALDI") ion source or a Desorption Ionisation on Silicon ("DIOS") ion source. Alternatively, a continuous ion source may be used. The continuous ion source may comprise an Electron Impact ("EI") ion source, a Chemical Ionisation ("CI") ion source, an Electrospray Ionisation ("ESI") ion source, an Atmospheric Pressure Chemical Ionisation ("APCI") ion source, an Atmospheric Pressure Photon Ionisation ("APPI") ion source, a Fast Atom Bombardment ("FAB") ion source, a Liquid Secondary Ion Mass Spectrometry ("LSIMS") ion source, a Field Ionisation ("FI") ion source and a Field Desorption ("FD") ion source. Other continuous or pseudo-continuous ion sources may also be used.

In one embodiment the mass spectrometer may be operated at or near atmospheric pressure and may be of the form as disclosed in GB-2369722 which is incorporated herein for reference. According to this embodiment a mass spectrometer may be provided comprising an ion source and a centrifuge mass separator. A mass analyser is preferably arranged downstream of the ion source and centrifuge mass separator. The centrifuge mass separator preferably comprises a chamber having a sample inlet and an inlet for a drying gas. At least one of the inlets is preferably arranged so as to tangentially inject a sample or drying gas into the chamber. In use a centrifugal force may be used to separate particles within the chamber.

In another embodiment the mass spectrometer may operated at a pressure in the range from 0.1 mbar to 10 mbar, and may use the mass selection principles disclosed in WO 2008/071967 which is incorporated herein by reference. According to this embodiment, a mass spectrometer may be provided comprising a device for separating ions temporally. In a first mode of operation the device is arranged and adapted to separate ions temporally according to their ion mobility. In a second mode of operation the device is arranged and adapted to separate ions according to their mass to charge ratio.

According to another embodiment the mass spectrometer may comprise a device as disclosed in WO2005/067000 which is incorporated herein by reference. According to this embodiment ions are supplied in a body of a gas. A ponderomotive ion trapping potential is preferably generated generally along an axis. Further potentials are preferably generated to provide an effective potential which prevents ions from being extracted from an extraction region. Ions are preferably arranged to be trapped in the effective potential. The device preferably further comprises a device to selectively extract ions having a predetermined mass to charge ratio or ion mobility from the extraction region. The characteristics of the effective potential which prevents ions from being extracted from the extraction region is preferably caused at least in part by the generation of the ponderomotive ion trapping potential.

According to another embodiment the mass spectrometer may comprise a device as disclosed in WO2007/010272 which is incorporated herein by reference. The mass spectrometer preferably comprises a mass or mass to charge ratio selective ion trap comprising a plurality of electrodes. A first mass filter or mass analyser is preferably arranged downstream of the mass or mass to charge ratio selective ion trap. A control device is preferably provided which is preferably arranged and adapted to cause ions to be selectively ejected or released from the ion trap according to their mass or mass to charge ratio. The control device is also preferably arranged to scan the first mass filter or mass analyser in a substantially synchronised manner with the selective ejection or release of ions from the ion trap.

According to other embodiments the mass spectrometer may be operated at a pressure less than 0.1 mbar or greater than 10 mbar.

Other embodiments are also contemplated wherein multiple stages of separation may be employed in tandem. For example, a configuration is contemplated comprising a source of ions and a means of sampling these ions. An ion mobility spectrometer or separator followed by a mass spectrometer may preferably be provided downstream of the ion source. An ion detector according to the preferred embodiment is preferably provided as part of the mass spectrometer.

Although the present invention has been described with reference to preferred embodiments, it will be understood by those skilled in the art that various changes in form and detail may be made without departing from the scope of the invention as set forth in the accompanying claims.

The invention claimed is:

1. A mass spectrometer comprising a Gas Electron Multiplier ion detector, wherein said ion detector comprises a first gas electron multiplier stage and one or more counter electrodes arranged adjacent said first gas electron multiplier stage.

2. A mass spectrometer as claimed in claim 1, further comprising a device arranged and adapted either:

(a) to maintain said ion detector at a pressure selected from the group consisting of: (i)<1000 mbar; (ii)<100 mbar; (iii)<10 mbar; (iv)<1 mbar; (v)<0.1 mbar; (vi)<0.01 mbar; (vii)<0.001 mbar; (viii)<0.0001 mbar; and (ix) <0.00001 mbar; or (b) to maintain said ion detector in a mode of operation at a pressure selected from the group consisting of: (i)>1000 mbar; (ii)>100 mbar; (iii)>10 mbar; (iv)>1 mbar; (v)>0.1 mbar; (vi)>0.01 mbar; (vii)>0.001 mbar; and (viii)>0.0001 mbar; or (c) to maintain said ion detector in a mode of operation at a pressure selected from the group consisting of: (i) 0.0001-0.001 mbar; (ii) 0.001-0.01 mbar; (iii) 0.01-0.1 mbar; (iv) 0.1-1 mbar; (v) 1-10 mbar; (vi) 10-100 mbar; and (vii) 100-1000 mbar.

3. A mass spectrometer as claimed in claim 1, wherein said ion detector is arranged and adapted to detect ions having an energy selected from the group consisting of: (i)<1 eV; (ii) 1-5 eV; (iii) 5-10 eV; (iv) 10-15 eV; (v) 15-20 eV; (vi) 20-25 eV; (vii) 25-30 eV; (viii) 30-35 eV; (ix) 35-40 eV; (x) 40-45 eV; (xi) 45-50 eV; (xii) 50-55 eV; (xiii) 55-60 eV; (xiv) 60-65 eV; (xv) 65-70 eV; (xvi) 70-75 eV; (xvii) 75-80 eV; (xviii) 80-85 eV; (xix) 85-90 eV; (xx) 90-95 eV; (xxi) 95-100 eV; (xxii) 100-105 eV; (xxiii) 105-110 eV; (xxiv) 110-115 eV; (xxv) 115-120 eV; (xxvi) 120-125 eV; (xxvii) 125-130 eV; (xxviii) 130-135 eV; (xxix) 135-140 eV; (xxx) 140-145 eV; (xxxi) 145-150 eV; (xxxii) 150-155 eV; (xxxiii) 155-160 eV; (xxxiv) 160-165 eV; (xxxv) 165-170 eV; (xxxvi) 170-175 eV; (xxxvii) 175-180 eV; (xxxviii) 180-185 eV; (xxxix) 185-190 eV; (xl) 190-195 eV; (xli) 195-200 eV; and (xlii)>200 eV.

4. A mass spectrometer as claimed in claim 1, wherein said ion detector comprises a first foil layer, or a first substrate.

5. A mass spectrometer as claimed in claim 4, wherein 0-5%, 5-10%, 10-15%, 15-20%, 20-25%, 25-30%, 30-35%, 35-40%, 40-45%, 45-50%, 50-55%, 55-60%, 60-65%, 65-70%, 70-75%, 75-80%, 80-85%, 85-90%, 90-95% or 95-100% of an upper or lower surface of said first foil layer, said first substrate or said first gas electron multiplier stage comprises a first surface layer or coating which is either:

(i) arranged and adapted to enhance the yield of secondary ions or electrons; or (ii) a photocathode layer which is arranged and adapted to receive photons and to release photoelectrons.

6. A mass spectrometer as claimed in claim 4, wherein said ion detector comprises a second foil layer, a second substrate or a second gas electron multiplier stage.

7. A mass spectrometer as claimed in claim 6, wherein 0-5%, 5-10%, 10-15%, 15-20%, 20-25%, 25-30%, 30-35%, 35-40%, 40-45%, 45-50%, 50-55%, 55-60%, 60-65%, 65-70%, 70-75%, 75-80%, 80-85%, 85-90%, 90-95% or 95-100% of an upper or lower surface of said second foil layer, said second substrate or said second gas electron multiplier stage comprises a second surface layer or coating which is either:

(i) arranged and adapted to enhance the yield of secondary ions or electrons; or (ii) a photocathode layer which is arranged and adapted to receive photons and to release photoelectrons.

8. A mass spectrometer as claimed in claim 6, wherein said ion detector comprises a third foil layer, a third substrate, or a third gas electron multiplier stage.

9. A mass spectrometer as claimed in claim 8, wherein 0-5%, 5-10%, 10-15%, 15-20%, 20-25%, 25-30%, 30-35%, 35-40%, 40-45%, 45-50%, 50-55%, 55-60%, 60-65%, 65-70%, 70-75%, 75-80%, 80-85%, 85-90%, 90-95% or 95-100% of an upper or lower surface of said third foil layer, said third substrate or said third gas electron multiplier stage comprises a third surface layer or coating which is either:

(i) arranged and adapted to enhance the yield of secondary ions or electrons; or (ii) a photocathode layer which is arranged and adapted to receive photons and to release photoelectrons.

10. A mass spectrometer as claimed in claim 8, wherein said ion detector comprises a fourth foil layer, a fourth substrate or a fourth gas electron multiplier stage.

11. A mass spectrometer as claimed in claim 10, wherein 0-5%, 5-10%, 10-15%, 15-20%, 20-25%, 25-30%, 30-35%, 35-40%, 40-45%, 45-50%, 50-55%, 55-60%, 60-65%, 65-70%, 70-75%, 75-80%, 80-85%, 85-90%, 90-95% or 95-100% of an upper or lower surface of said fourth foil layer, said fourth substrate or said fourth gas electron multiplier stage comprises a fourth surface layer or coating which is either:

(i) arranged and adapted to enhance the yield of secondary ions or electrons; or (ii) a photocathode layer which is arranged and adapted to receive photons and to release photoelectrons.

12. A mass spectrometer as claimed in claim 4, wherein said ion detector comprises one or more electrodes, counter electrodes or cathodes arranged either:

(i) facing or opposed to said first foil layer, said first substrate or said first gas electron multiplier stage; or (ii) in a drift or input region of said ion detector; or (iii) to receive analyte cations and to release secondary electrons or secondary anions or secondary cations.

13. A mass spectrometer as claimed in claim 12, wherein said one or more electrodes, counter electrodes or cathodes comprise:

(i) one or more planar electrodes; or (ii) one or more grid or mesh electrodes; or (iii) one or more electrodes having one or more apertures through which ions or analyte cations may be transmitted in use.

14. A mass spectrometer as claimed in claim 1, wherein said ion detector has a gain selected from the group consisting of: (i)<10; (ii) 10-100; (iii) 100-1000, (iv) $10^3$-$10^4$; (v) $10^4$-$10^5$; (vi) $10^5$-$10^6$; (vii) $10^6$-$10^7$; and (viii)>$10^7$.

15. A method of mass spectrometry comprising:

using a Gas Electron Multiplier ion detector to detect ions, wherein said ion detector comprises a first gas electron multiplier stage and one or more counter electrodes arranged adjacent said first gas electron multiplier stage.

* * * * *